US006053423A

United States Patent [19]

Jacobsen et al.

[11] Patent Number: 6,053,423

[45] Date of Patent: Apr. 25, 2000

[54] FOUNTAIN WITH VARIABLE SPRAY PATTERNS

[75] Inventors: Stephen C. Jacobsen; Fraser Smith; David F. Knutti; Mike Morrison, all of Salt Lake City, Utah

[73] Assignee: Sarcos, Inc., Salt Lake City, Utah

[21] Appl. No.: 09/170,479

[22] Filed: Oct. 13, 1998

[51] Int. Cl.[7] ..... B05B 17/08; F21S 8/00

[52] U.S. Cl. ..... 239/18; 239/17

[58] Field of Search ..... 239/16–23

[56] References Cited

U.S. PATENT DOCUMENTS

| | | | |
|---|---|---|---|
| Re. 35,866 | 8/1998 | Simmons | 239/17 |
| 4,094,464 | 6/1978 | Kawamura et al. . | |
| 4,661,893 | 4/1987 | Robinson et al. | 362/267 |
| 4,821,805 | 4/1989 | Saito et al. | 169/61 X |
| 4,889,283 | 12/1989 | Fuller et al. . | |
| 4,892,250 | 1/1990 | Fuller et al. . | |
| 4,909,329 | 3/1990 | Yoshida et al. . | |
| 4,955,540 | 9/1990 | Fuller et al. . | |
| 5,069,387 | 12/1991 | Alba . | |
| 5,078,320 | 1/1992 | Fuller et al. . | |
| 5,115,973 | 5/1992 | Fuller et al. . | |
| 5,152,210 | 10/1992 | Chen . | |
| 5,340,024 | 8/1994 | Fuller et al. . | |
| 5,524,822 | 6/1996 | Simmons . | |

*Primary Examiner*—Andres Kashnikow
*Assistant Examiner*—Sean P. O'Hanlon
*Attorney, Agent, or Firm*—Thorpe, North, & Western

[57] ABSTRACT

A fountain apparatus includes a nozzle and lights which are selectable and moveable in at least two degrees of freedom about axes that are approximately perpendicular. Nozzle movement is preferably controlled by preprogrammed electronics which control movement of the nozzle and selective activation of the lights. Such an automated control system also may control the spray stream velocity. The flow streams are controlled to create a dynamic display which may be synchronized to music or other light shows.

45 Claims, 21 Drawing Sheets

FOUNTAIN WITH VARIABLE SPRAY PATTERNS

BACKGROUND OF THE INVENTION

1. The Field of the Invention

The present invention relates generally to water fountains that create ornamental displays of water. More particularly, it concerns a water fountain device capable of varying stream flow velocity, trajectory pattern and direction.

2. The Background Art

It is common practice to see water fountain displays where spray nozzles are stationary and unable to articulate in order to change the trajectory of water dispensed therefrom. Typically, water fountain displays use simple, vertical or angled sprays in a fixed position combined in geometric proportions and repetitions to achieve dynamic performances. Ornamental fountain displays in the past have included statues, sculptures or other forms of artistic attractions such as gardens to enhance the interest of viewers.

Presently, water fountains are advancing with technology to become dynamic spectacles that are aesthetically entertaining. Lights and music are often added to fountain displays to transform the fountain from a side show to a main attraction. Apparatuses combining a water fountain with lights and sound can be found in U.S. Pat. Nos. 5,069,387 and 5,152,210. In U.S. Pat. No. 5,069,387, the apparatus synchronizes music to water and light performances. The water display may be varied by selectively controlling each valve to vary the flow of the stream. Likewise, U.S. Pat. No. 5,152,210 discloses modular water and light performing equipment. The apparatus synchronizes music to water and light performance by controlling the height and frequency of the water spurts with the rhythm music.

In U.S. Pat. No. 4,955,540 and divisions thereof (U.S. Pat. Nos. 5,078,320 and 5,115,973), the apparatus produces water displays with varying angles and pressures in laminar flow nozzles such that a stream of water is emitted from a nozzle at one end of an arc and collected in a sink at the other end. The patents also disclose the ability to collide two water streams in the middle of an arc when the streams are emitted from two nozzles at opposite ends of the arc. The water display relies on a programmed angle and pressure to cause the emitted stream to hit a target. The nozzle is moveable in two rotational directions that vary the angular trajectory of the streams of water. The two rotational directions are in the same plane to change the angle of the stream trajectory, while making it appear to an observer that the stream is emitted from the same point. The patent also discloses the use of a light source that may be employed to illuminate the streams of water as they are dispensed from the apparatus.

It is noteworthy that none of the references known to the applicant provides a fountain with the capability of articulating a nozzle in at least two degrees of freedom about two axes that are approximately perpendicular. Thus, it would be advantageous to provide a fountain which allows control of various features and movement such as varying nozzle trajectory, direction, flow height and spray patterns. In addition, it would be advantageous to provide lights independently or conjointly controlled with the nozzle to illuminate, in a desired manner, the spray patterns. Moreover, it would be advantageous to provide a water fountain where each feature can be controlled in countless ways to create a multitude of effects.

OBJECTS AND SUMMARY OF THE INVENTION

It is therefore an object of the present invention to provide a water fountain which is capable of varying stream flow velocity, trajectory and direction.

It is another object of the present invention to provide such a water fountain which is automated to control water pressure, nozzle movement, lighting effects, and/or coordinating music in repetitions or geometric patterns.

It is a further object of the present invention, in accordance with one aspect thereof, to provide a water fountain which is capable of submerging all or part of itself under a pool of water while not in operation or in various modes of operation.

It is an additional object of the invention, in accordance with one aspect thereof, to provide a water fountain with variable positions where attached lights track the stream flow.

It is another object of the invention to provide a dynamic water fountain attraction that utilizes preset programable patterns to articulate the spray nozzle and accompanying lights.

It is yet another object of the invention to provide multiple fountains choreographed together to create a visual display.

The above objects and others not specifically recited are realized in a specific illustrative embodiment of a water fountain apparatus.

A water fountain in accordance with the present invention comprises at least one nozzle and a means for moving the nozzle in at least two degrees of freedom about two axes that are approximately perpendicular. The means for moving may comprise at least one servo-motor, pneumatic cylinder, or motor used in conjunction with a chain and sprocket system, gear sets, belt and pulley system, or other apparatus known by one skilled in the art. The movement of the nozzle in the fountain apparatus may be translatory and/or rotational. The fountain apparatus according to the present invention has a wide range of motion. Preferably, two servo-motors or other means for rotating components of the fountain are used to rotate the components in at least two different axes and for positioning the nozzle to any selectable degree or position within at least a semi-spherical space.

The movement of the fountain apparatus is preferably provided by an automated control system which controls the movement of the nozzle and thus a trajectory of a liquid that is emitted from the nozzle. The automated control system may also control the rotational movement of the nozzle in pivotal movement. In addition, each nozzle may include at least one manually or automatically interchangeable nozzle for providing various spray patterns and thus altering the spray pattern of the water.

Additionally, the fountain apparatus comprises a liquid source in fluid communication with the nozzle for providing a pressurized flow. The liquid source may comprise a pool of liquid (e.g. water) and a pump in fluid communication with the pool, or a pressurized container of liquid. Also, the pump may be coupled to an arm for providing a counterweight for the nozzle assembly. The pump provides a counterweight for reducing the force required to raise the nozzle support structure. Also, using the pump as a counterweight will allow, for example, its associated small motors to be used to raise the nozzle assembly. The fountain apparatus also may further include a means associated with the liquid source for varying the pressurized flow to the nozzle (e.g. valve, variable flow pump, or other form of a restricting device). The automated control system may also control the means for varying the pressurized flow.

The fountain apparatus may further comprise a means for moving an arm pivotally mounted at a first portion to a nozzle support structure and the nozzle pivotally mounted to the nozzle support structure wherein the means may include at least one pneumatic cylinder servo motor, or motor used in conjunction with a chain and sprocket system, gears, belts, and pulley systems, or other apparatuses known by one skilled in the art. In addition, the fountain apparatus may further comprise an arm having a second portion pivotally mounted to a base structure for allowing further degrees of freedom of movement of the nozzle assembly. The fountain apparatus may also pivot the nozzle support structure relative to the arm and the arm relative to the base to selectively control the position of the nozzle as with an automated control system.

A third rotatable device may also be coupled to the arm and base support to give the fountain a third degree of freedom. This third range of motion raises and may allow lowering of the nozzle, lights, and nozzle support with respect to the liquid pool. The invention further claims a fountain apparatus where the nozzle is configured to be placed in a pool of liquid and the elevation of the nozzle can be selectively varied with respect to the liquid level. When the third rotatable device is actuated, the nozzle can be submerged under the liquid so that the fountain apparatus is not visible, e.g., during storage; partially submerged, e.g., during the day so that the nozzle is exposed but the lights are submerged; or non-submerged, e.g., during the night allowing the nozzle and lights to operate above the liquid level. Furthermore, the automated control system may regulate the height of the nozzle relative to a support surface whereas the elevation of the nozzle can be varied. The pressurized flow, nozzle angle and nozzle elevation may each be controlled by the automated control system.

The apparatus in accordance with the present invention may have a gimbal effect by rotating the first rotatable device in conjunction with the third rotatable device to maintain the nozzle in a level position. This "gimbal" allows the fountain to spray vertically, horizontally, or in any other direction while raising and lowering the fountain apparatus.

A light source may also be included for directing one or more light beams substantially toward the flow. The light source may include a spot light, laser, or other source of visible light. The light source movement may be controlled by the automated control system for articulating the light source in at least one degree of freedom. Preferably, when moving the spray nozzle to a certain angle, the lights track the water stream to provide the fountain with a display of color.

A support structure may also be further included in the fountain apparatus which is coupled to the nozzle for supporting it relative to a surface. The support structure may be attached to a stationary object or surface attached to a buoyant device.

A programable computer system may be included as part of the automated control system to control articulating movements of the nozzle assembly, spray pattern, lights, etc. Furthermore, the control system may also be capable of varying a flow trajectory, movement, and/or lights according to music rhythm.

Another embodiment of the fountain apparatus comprises a selectively rotatable device coupled to at least one nozzle and a nozzle support coupled to the rotatable device. The rotatable device is capable of rotating the nozzle relative to the nozzle support. The fountain further includes a second selectively rotatable device coupled to the nozzle support and a support arm coupled to the second rotatable device. The second rotatable device is capable of rotating the nozzle support relative to the support arm. In addition, in this preferred embodiment of the fountain, an automated control system controls the rotation of the two rotational devices and thus the direction of a flow stream of a liquid that is emitted from the nozzle. Furthermore, the fountain apparatus includes a liquid source in fluid communication with the nozzle for providing a pressurized flow.

Additional objects and advantages of the invention will be set forth in the description which follows, and in part will be apparent from the description, or may be learned by the practice of the invention without undue experimentation. The objects and advantages of the invention may be realized and obtained by means of the devices and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
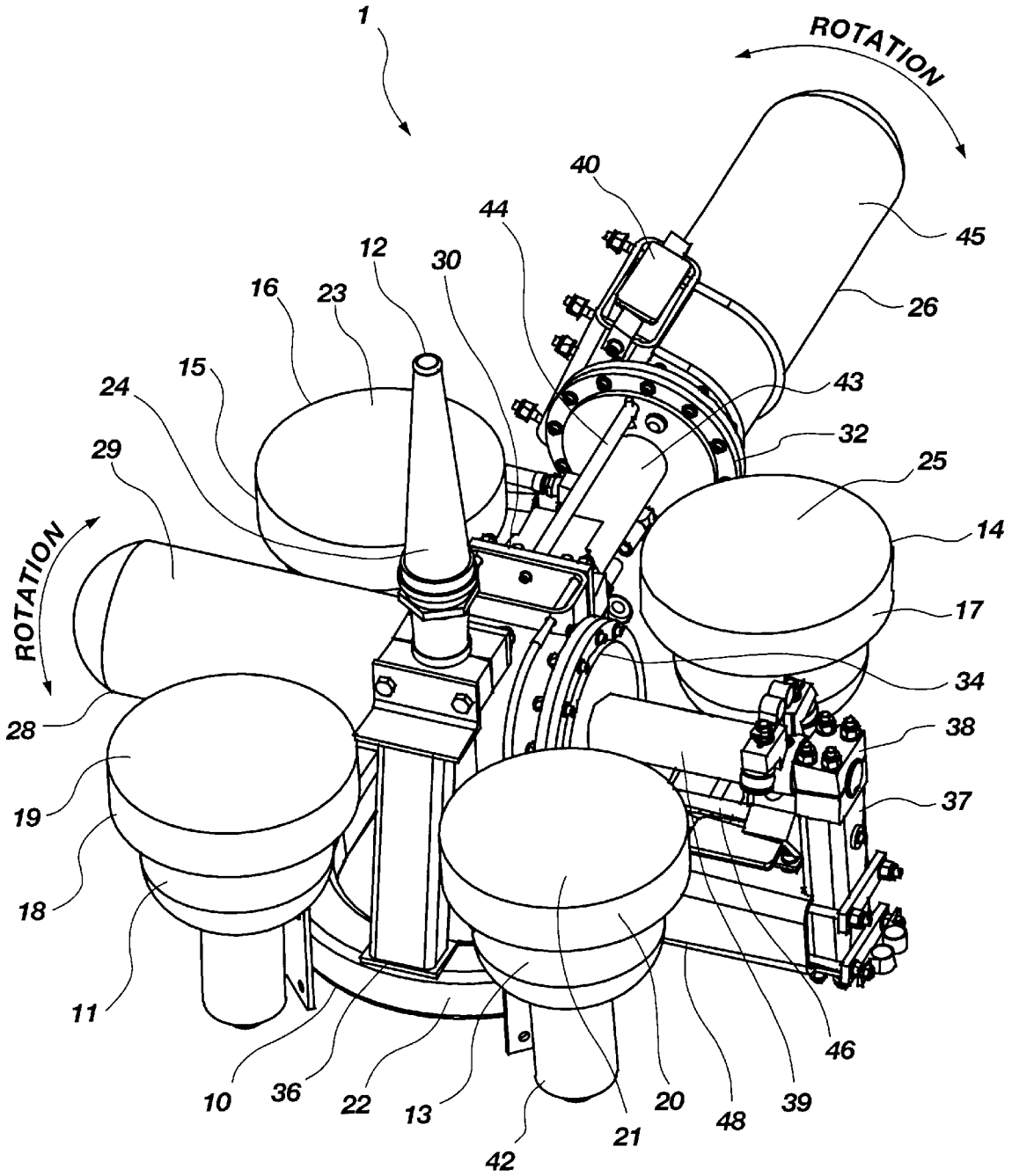
FIG. 1 is a detailed perspective view of a first preferred embodiment of a fountain apparatus made in accordance with the principles of the present invention.

Referring now to the drawings more specifically by reference numbers, FIG. 1 shows a fountain apparatus, generally indicated at 1, in accordance with the present invention. The preferred embodiment illustrates a fountain apparatus 1 capable of movement in at least two degrees of freedom, the axes of movement being approximately perpendicular to each other to allow nozzle 12 positioning at any location at least within a semi-spherical space. The diagram illustrates a nozzle assembly, generally indicated at 10, comprising a spray nozzle 12 attached to a distal end of a substantially rigid tube or hose 24. The tube 24, is attached to a nozzle support 22 as with a bracket or clamp 36. Light fixtures 11, 13, 15, and 17 are mounted to the nozzle support 22 and may be configured to house flood light bulbs (not shown). Each light fixture 11, 13, 15, and 17 is provided with a relatively transparent cover 19, 21, 23, and 25 that is secured to each fixture 11, 13, 15, and 17, respectively as with a watertight seal ring 14, 16, 18, 20. The fixtures 11, 13, 15, and 17 may be mounted to the support 22 by welding or by fastening the flange 42 to the support 22.

In this preferred embodiment, the nozzle support 22 has a U-shaped configuration and is coupled to a first servo-motor 28 with a bracket member 48. The bracket member 48 is secured to the support 22 at a proximal end and includes a shaft bracket assembly 37 attached to a distal end. The shaft 39 of the servo motor 28 is secured to the bracket assembly with a shaft clamp or bracket 38. The servo motor 28 is provided with a water-tight seal 34 which allows rotation of the shaft 39 and prevents water from entering the servo motor housing 29. Upon rotation of the support 22 relative to the servo motor 28, a position sensor 46 may be provided to prevent over rotation of the shaft 39 relative thereto. The first servo-motor 28 is coupled to a second servo-motor 26 by a shaft 43 which extends from the servo-motor 26 to a bracket/control box 30. As with the first servo motor, the servo motor 26 includes a seal member 32 to prevent water from entering into the servo motor housing 45. The second servo-motor 26 also includes a support arm bracket 40 for attachment to a control arm and a position sensor 44 for sensing rotational position of the nozzle 12 relative to the servo motor 26.

The use of the U-shaped support 22 in combination with the configuration of attachment of the first servo motor 28 and the second servo motor 26, allows the nozzle to be rotated to a point adjacent the second servo motor 26 such that a spray of water from the nozzle 12 would be near horizontal. In addition, rotation of the first servo motor 28 in the opposite direction would only be limited by contact of the U-shaped support bracket 22 with the shaft 43. In this position, the nozzle 12 would be rotated to a position that result in water sprayed therefrom to be at or beyond the horizontal. Likewise, rotation of the second servo motor 26 results in the nozzle 12 at least being capable of spraying water in at least a 180 degree arc, that is, from horizon to horizon. Moreover, the only limit in rotation of the second servo motor 26 may be the supply line (not shown) which supplies water to the tube 24. As such, the first and second servo motors 28 and 26, respectively, provide the ability to position the nozzle 12 at any location defined at least within a semi-spherical space and thus provides movement of the nozzle 12 in at least two degrees of freedom having axes that are substantially perpendicular to each other.

Figure 2:
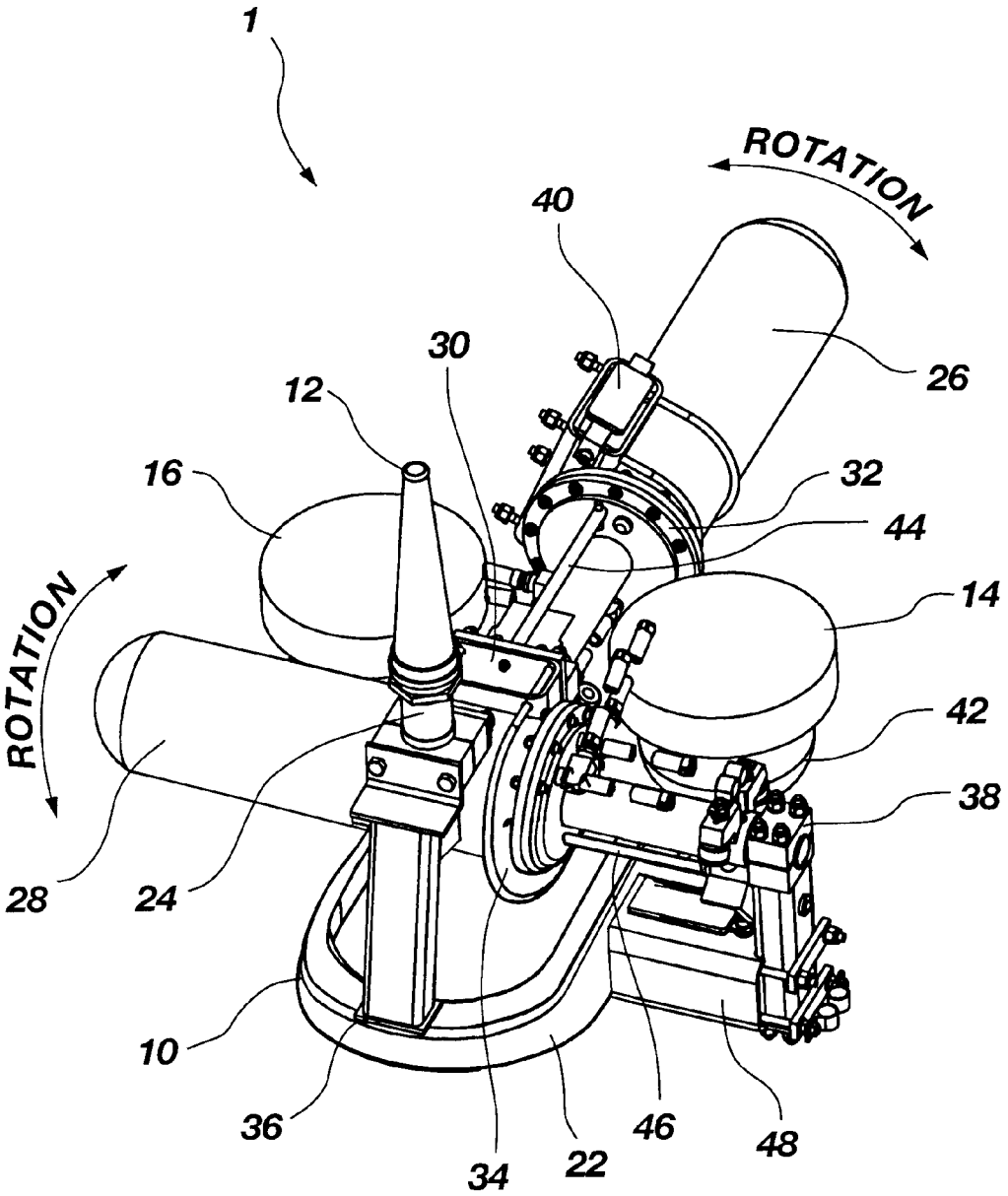
FIG. 2 is a perspective view of a second preferred embodiment of a fountain apparatus in accordance with the present invention.
Figure 3:
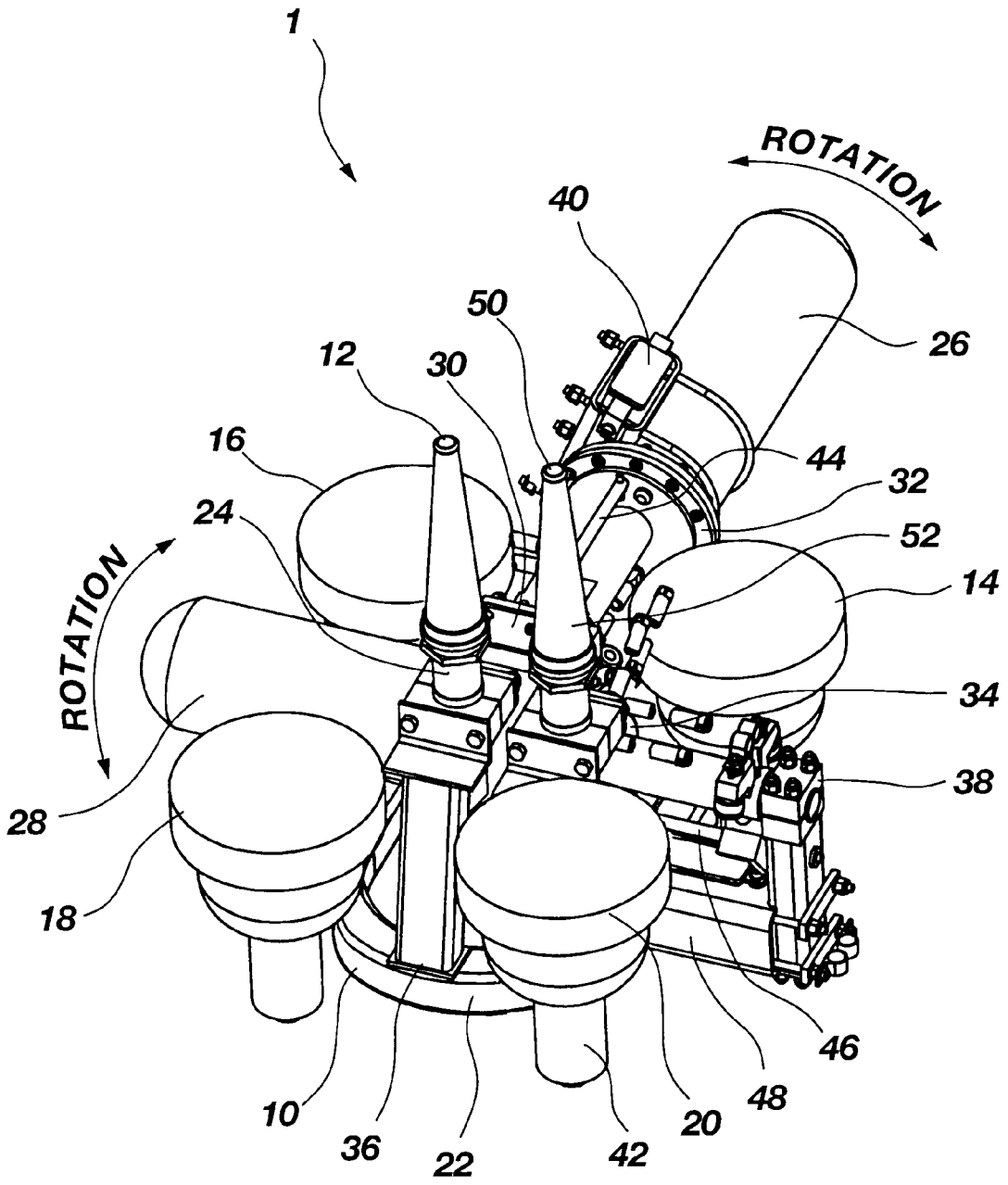
FIG. 3 is a perspective view of a third preferred embodiment of a fountain apparatus made in accordance with the principles of the present invention.
Figure 4:
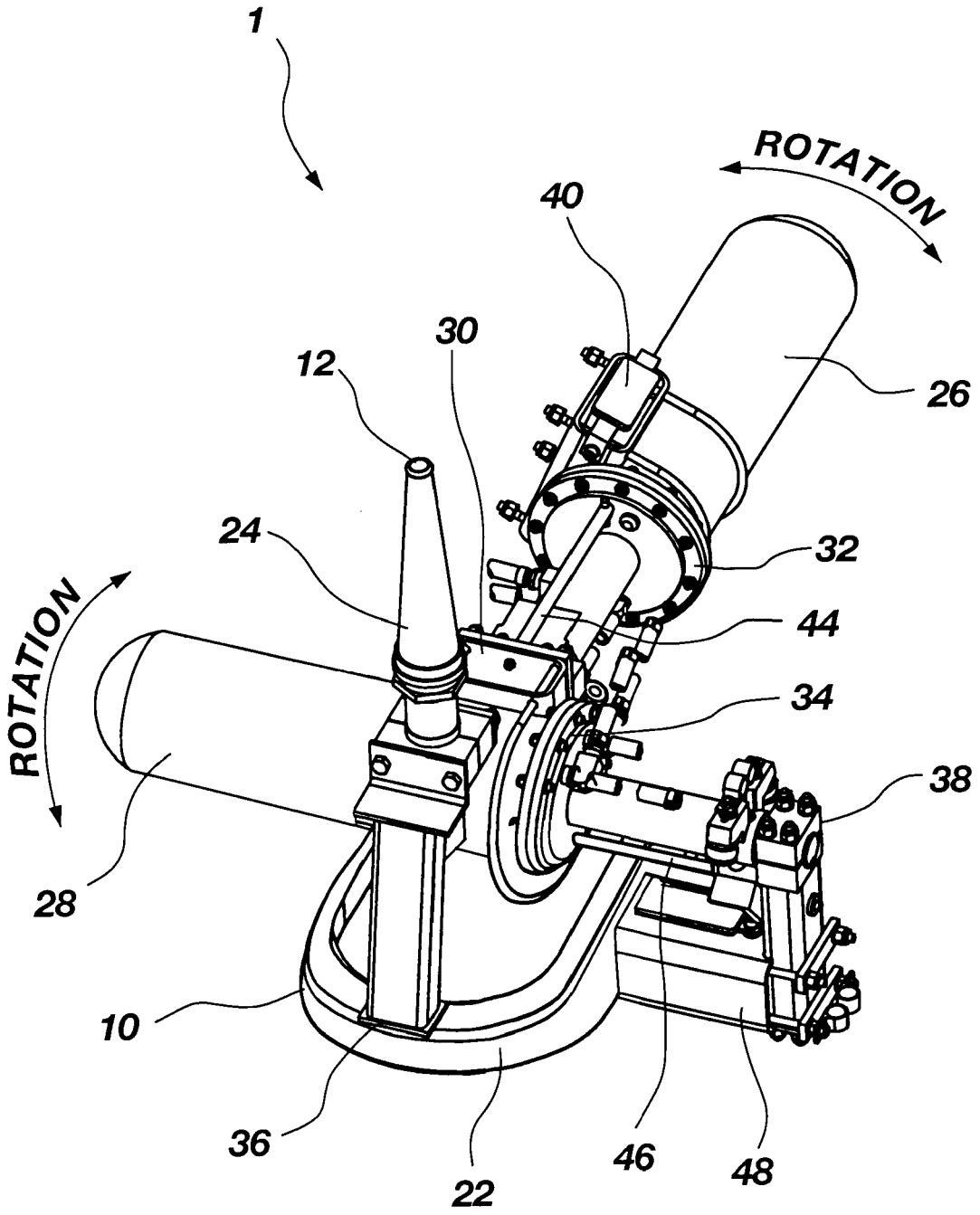
FIG. 4 is a perspective view of a fourth preferred embodiment of a fountain apparatus in accordance with the present invention.

Of course, those skilled in the art will appreciate after understanding the teachings of the present invention that modifications could be made to the fountain apparatus 1 within the spirit and scope of the present invention. For example, more, fewer, or different types of lights could be utilized with the fountain apparatus 1. Moreover, more or fewer nozzles 12 could be added to the fountain apparatus 1. For example, FIG. 2 illustrates an example of a nozzle assembly 10 utilizing one nozzle 12 with two lights 14 and 16. Likewise, FIG. 3 illustrates two nozzles 12, 50 with four flood lights 14, 16, 18, 20. Additionally, as illustrated in FIG. 4, the present invention may be practiced without the use of lights and shows a fountain apparatus 1 with a single nozzle assembly 10.

Figure 5C:
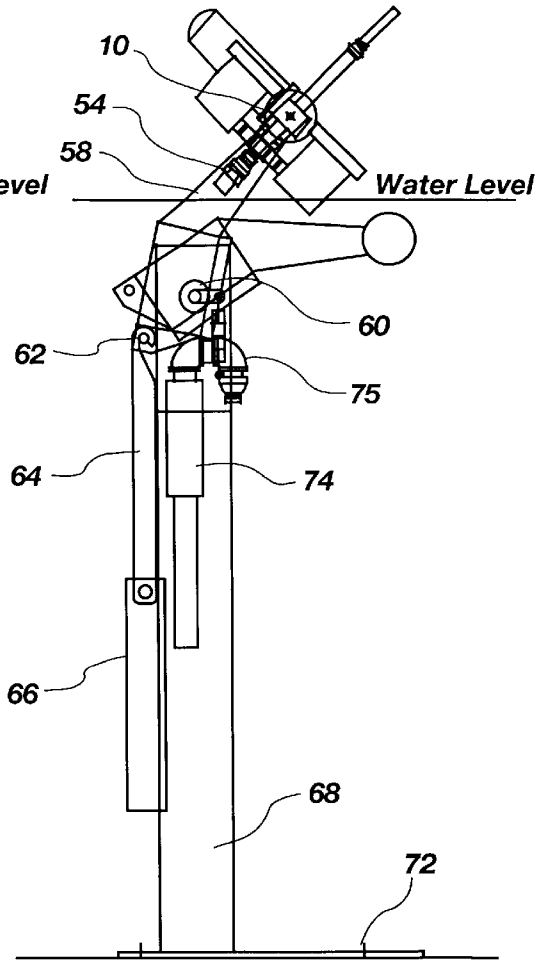
FIG. 5*c* is a side view of the fountain apparatus of FIG. 5*a* in night position (nonsubmerged) with respect to liquid level of a pool.
Figure 5B:
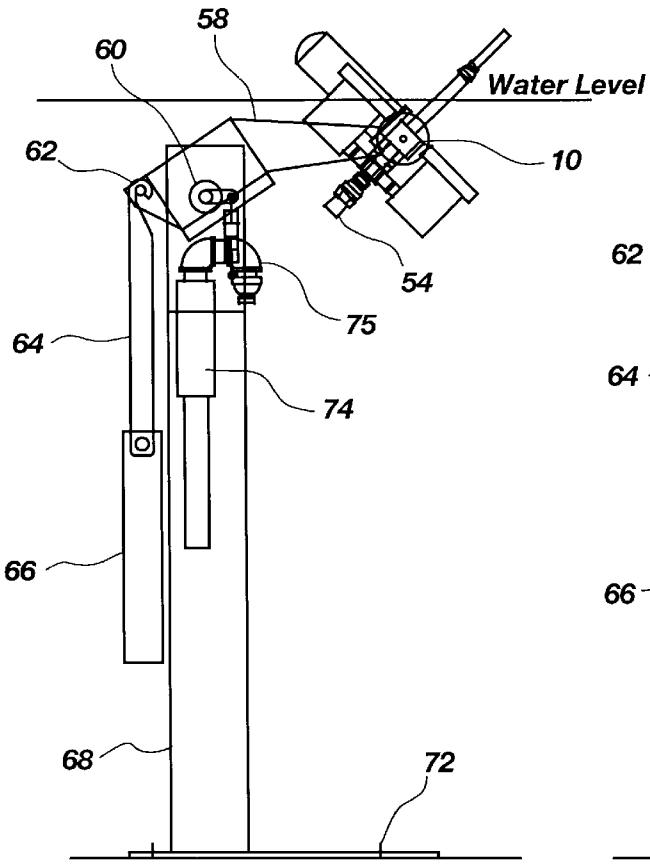
FIG. 5*b* is a side view of the fountain apparatus of FIG. 5*a* in day position (partially submerged) with respect to liquid level of a pool.
Figure 5A:
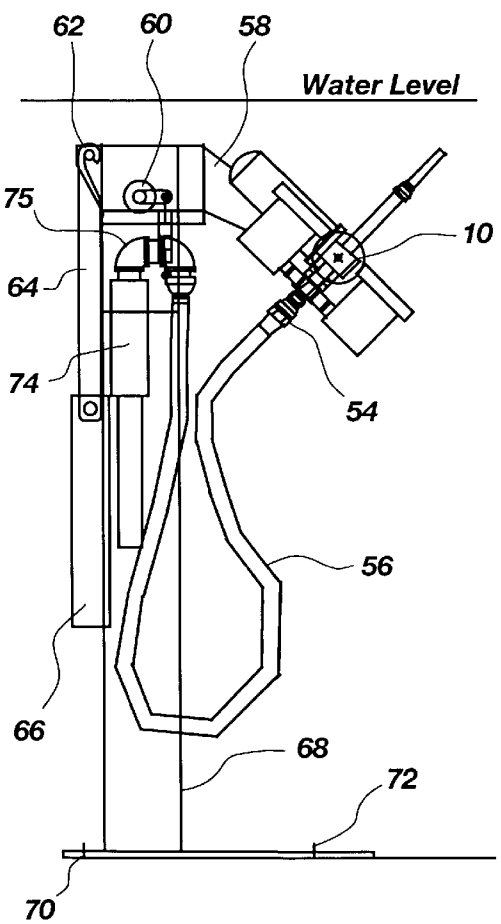
FIG. 5*a* is a side view of the fountain apparatus of FIG. 1 in a hidden position (submerged) with respect to liquid level of a pool.

Referring now to FIGS. 5*a*, 5*b*, and 5*c*, the nozzle assembly 10 is illustrated in three separate positions with respect to liquid level of a pool. The first figure, FIG. 5*a* is an example of the nozzle assembly 10 in a submerged position. FIG. 5*b* and FIG. 5*c* are other examples of the fountain apparatus of FIG. 5*a* where in FIG. 5*b* the nozzle assembly 10 is partially submerged, and in FIG. 5*c* the nozzle assembly is extended above the water level. The fountain apparatuses of FIGS. 5*a*, 5*b*, and 5*c* illustrate a nozzle assembly 10 coupled to a support arm 58 which is pivoted with a support arm pivot 60 by employing a third rotatable device, such as a servo moter, with respect to a base support 68. The ability to raise and lower the nozzle assembly 10 provides an additional degree of freedom. Preferably, the support arm 58 is balanced about the base support 68 with a counterweight 66 which is attached by a hanger or plate 64 and pivoted on the support arm 58 by a steel bar or pivot bearing 62. The base support 68 contains a foundation plate 70 which is used to affix the base support 68 to the foundation by anchor bolts 72. A submersible variable flow pump 74 is attached to or anchored near the base support 68 to pump fluid through a flexible hose 56 that is attached to the pump with hose fittings and connectors 75 and a nozzle hose coupling 54 or other means known in the art.

Figure 6B:
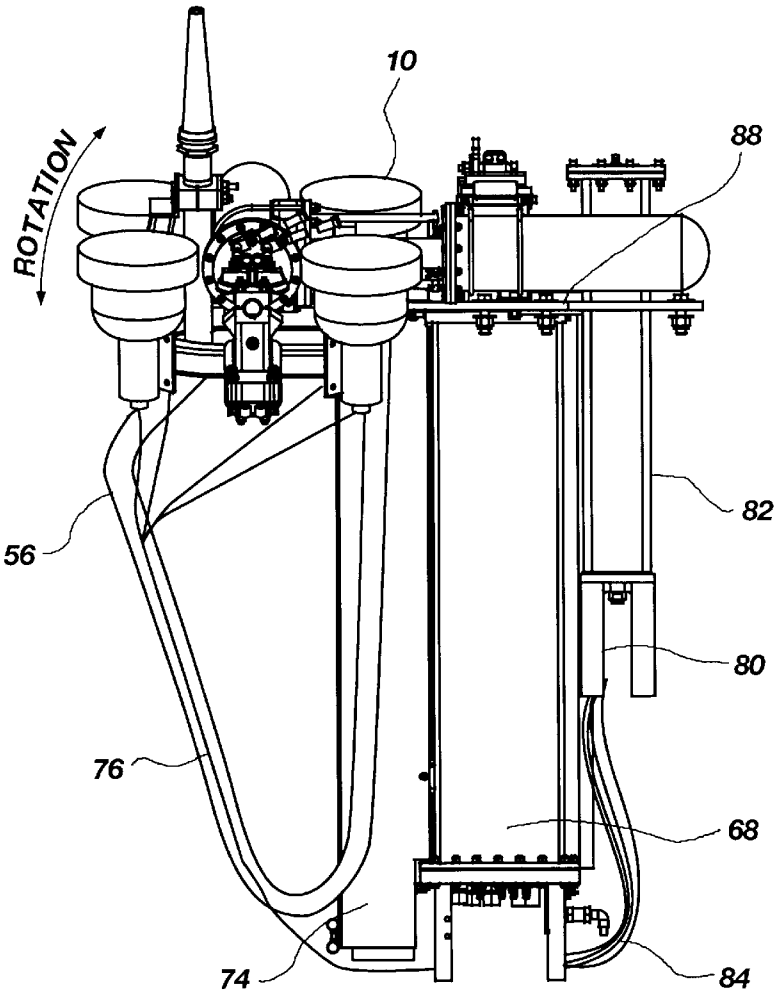
FIG. 6*b* is a side view of the fountain apparatus of FIG. 6*a* illustrating rotational movement of the second rotatable device.
Figure 6A:
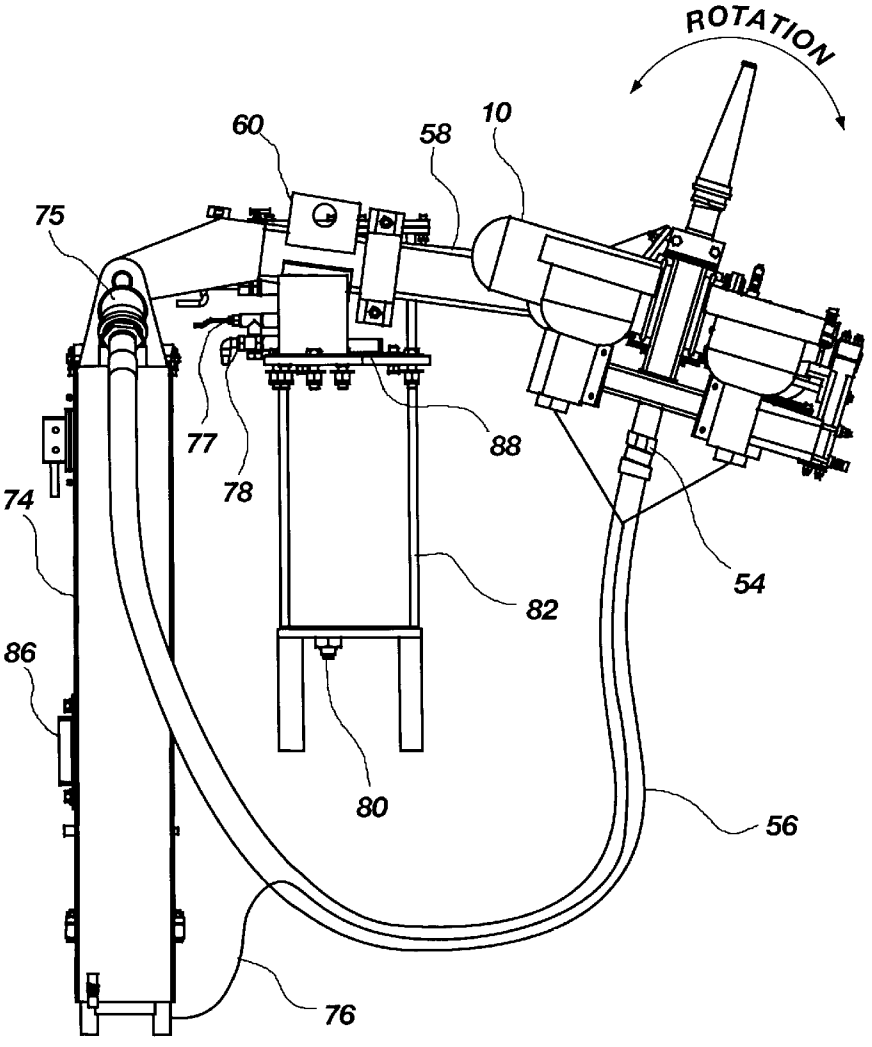
FIG. 6*a* is a side view of the fountain apparatus of FIG. 1 illustrating rotational movement of the first rotatable device.

As illustrated in FIGS. 6*a* and 6*b*, the fountain apparatus may be rotated about two axes that are substantially perpendicular to each other. As further shown, the fountain apparatus further includes an illustration of the submersible pump 74 being used as a counterweight to the weight of the nozzle assembly 10. A base support frame 82 provides the fulcrum between the nozzle assembly 10 and the pump 74. Moreover, the top of the base support 68 is provided with air connection terminals 77, 78, 80 for providing a means for powering the rotatable devices. Moreover, the bottom of the base support 68 contains actuator, pump, and motor electrical cables 84 to provide power for the respective mechanisms. Light power cables 76 provide a means for providing electrical current to power the flood lights 14, 16, 18, 20. Zinc anodes 86, 88 may be added to provide corrosion resistence to the steel components in the fountain apparatus.

Figure 7C:
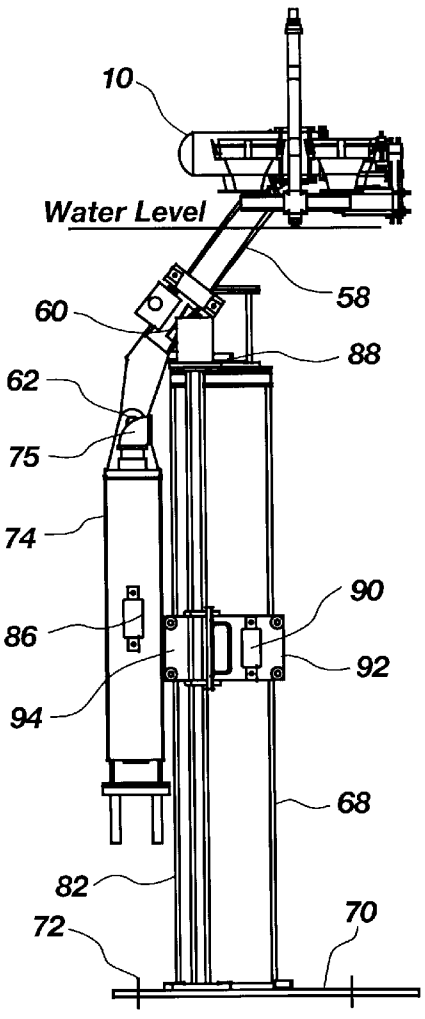
FIG. 7*c* is a side view of the fountain apparatus of FIG. 7*a* in night position (non-submerged) with respect to liquid level of a pool.
Figure 7B:
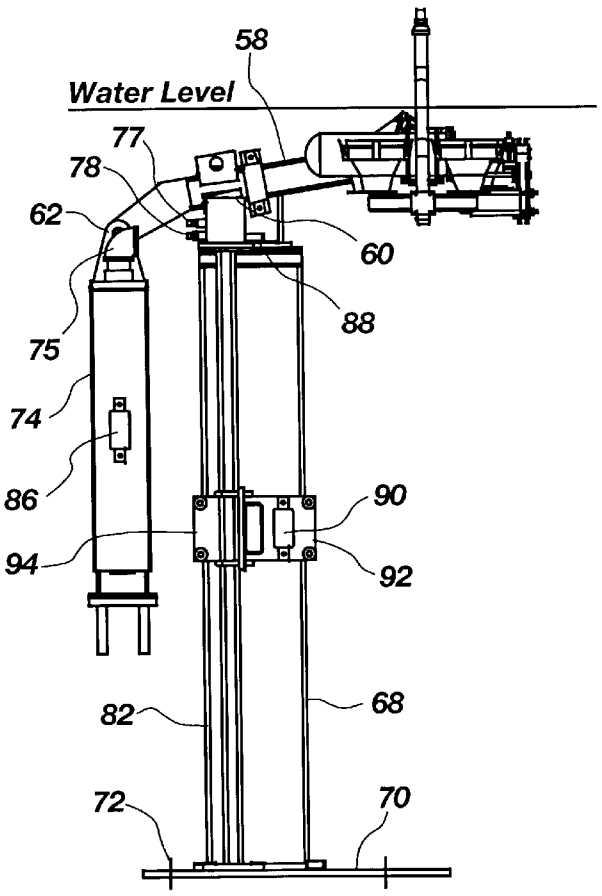
FIG. 7*b* is a side view of the fountain apparatus of FIG. 7*a* in day position (partially submerged) with respect to liquid level of a pool.
Figure 7A:
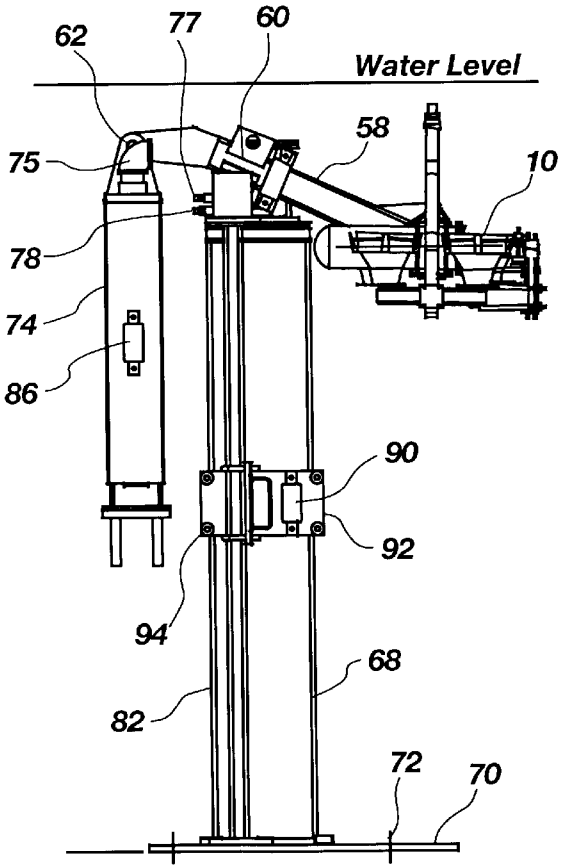
FIG. 7*a* is a side view of the fountain apparatus of FIG. 1 in hidden position (submerged) with respect to liquid level of a pool.

The examples in FIGS. 7*a*, 7*b*, and 7*c* are alternative embodiments to the fountain apparatus illustrated in FIGS. 5*a*, 5*b*, and 5*c*. The fountain apparatus of FIGS. 71–7*c* include a submersible pump 74 as a counterweight to the nozzle assembly 10 and a base support frame 82 for added rigidity to the fountain apparatus. FIG. 7 also shows the fountain apparatus in three different positions. FIG. 7*a* is an example of the nozzle assembly 10 in hidden position, i.e., submerged. FIGS. 7*b* and 7*c* are other examples of the fountain apparatus of FIG. 7*a* where 7*b* is set in day position, i.e., partially submerged, and FIG. 7*c* is set in night position, i.e., non-submerged. FIG. 7 further includes a base support splice plate 92 to join an upper and lower section of the base support 68 for easy access during maintenance to cable and hose connection points. Zinc anodes 86, 88, 90 may be added to the fountain apparatus for corrosion resistence.

Figure 8:
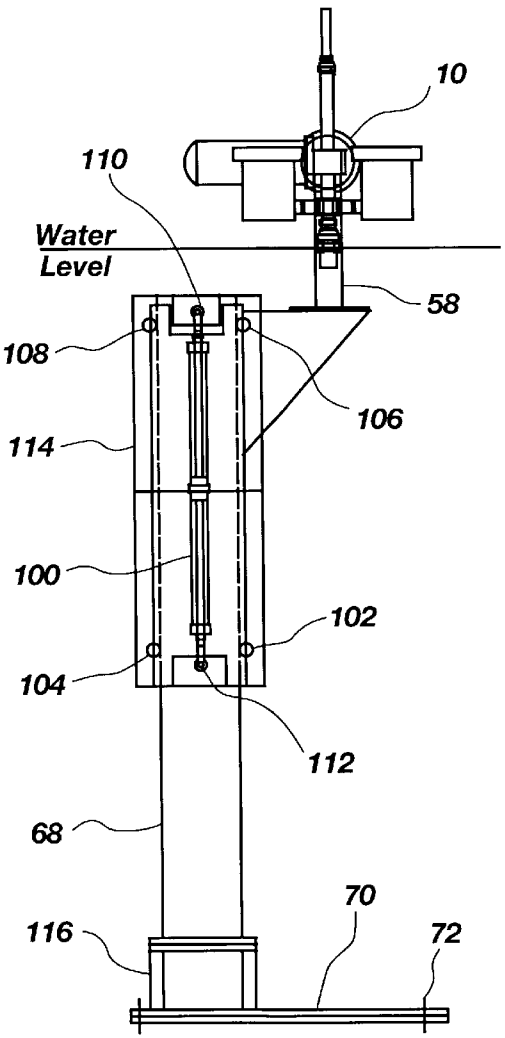
FIG. 8 is a side view of the fountain apparatus of FIG. 1 in night position (non-submerged) with respect to liquid level of a pool illustrating an alternative embodiment for selectively varying an elevation of a nozzle with pneumatic cylinders.

Other embodiments have been included to illustrate the various methods for selectively adjusting the elevation of the nozzle assembly 10. FIG. 8 is an example using pneumatic cylinders to vary the height. The nozzle assembly 10 is connected to a support arm 58 which is raised and lowered by a lift structure 114. The lift structure 114 rolls on a base support 68 with linear roller bearings 102, 104, 106, 108 and moved by a dual position linear pneumatic cylinder 100 which is connected to the lift structure by a connection plate 1 12 and supported by the base support 68 with a connection plate 110. The base support 68 rests on a clearance stop 116 to prevent the hoses and cables from being damaged.

Figure 9:
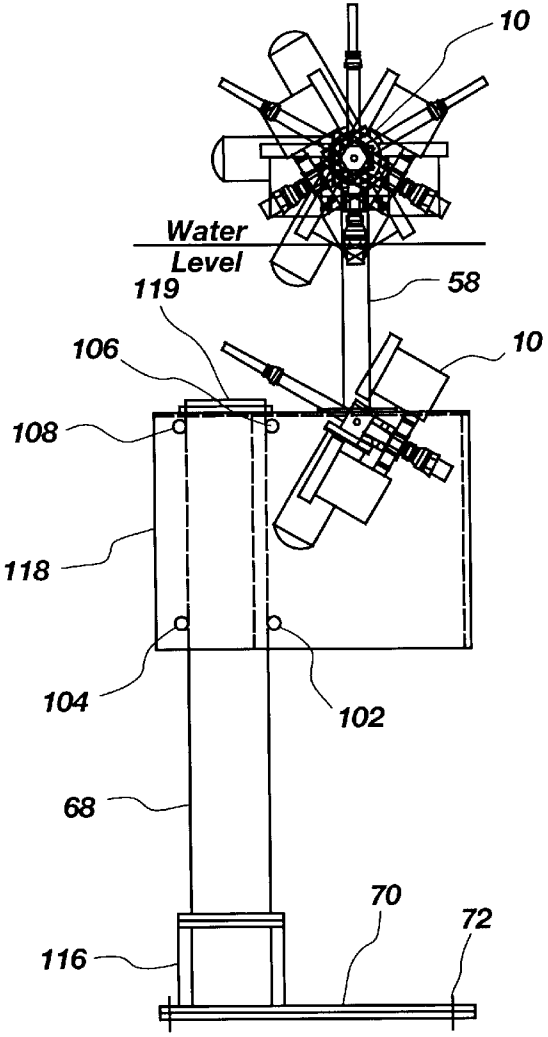
FIG. 9 is a side view of the fountain apparatus of FIG. 1 in night position (non-submerged) with respect to liquid level of a pool illustrating an alternative embodiment for selectively varying an elevation of a nozzle with a buoyant tank.

Another embodiment illustrated in FIG. 9 uses a buoyant tank 118 to vary the elevation of the nozzle assembly 10 which is connected to the buoyant tank 118 by a support arm 58. The buoyant tank 118 rides on a base support 68 with linear roller bearings 102, 104, 106, 108 and includes a clearance stop 116 at the foot and an upper stop 119 at the top.

Figure 10:
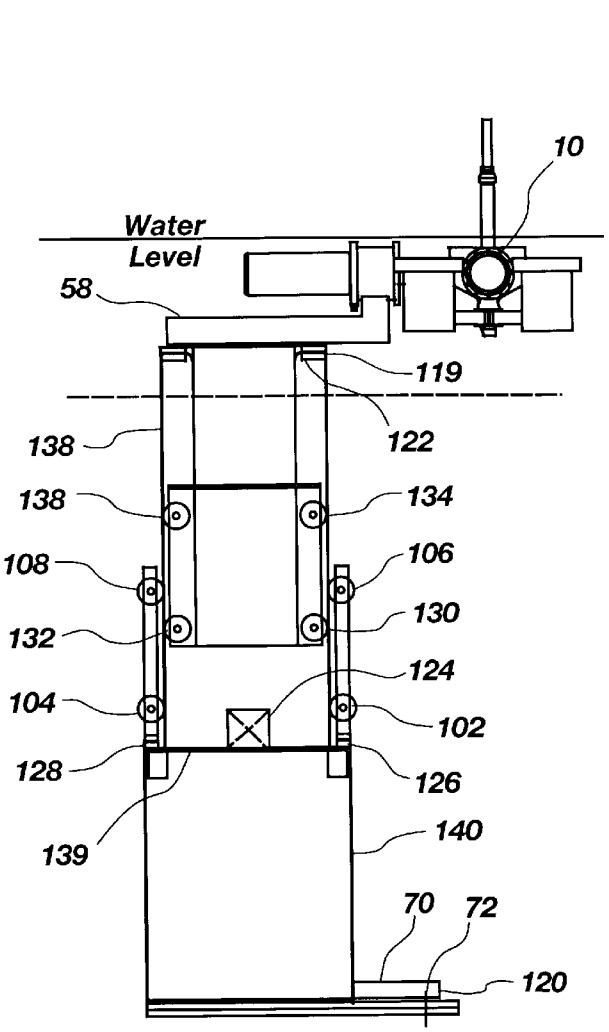
FIG. 10 is a side view of the fountain apparatus of FIG. 1 in night position (non-submerged) with respect to liquid level of a pool illustrating an alternative embodiment for selectively varying an elevation of a nozzle with two buoyant air lift tubes.

A telescoping water cylinder is used in FIG. 10 to achieve a variable elevation. A water inlet 120 allows water to enter the lower pressurized chamber 140 to push up against a middle lift tube/pressurized chamber 139 which rolls on linear roller bearings 102, 104, 106, 108 until the lift tube 139 contacts the middle stop 126. When a valve 124 is shut, an upper lift tube 138 continues to raise on linear roller bearings 130, 132, 134, 136 until the lift tube 138 contacts an upper stop 119. The water pressure is contained in the pressurized chambers 139, 140 with an upper seal 122 and a lower seal 128.

Figure 11C:
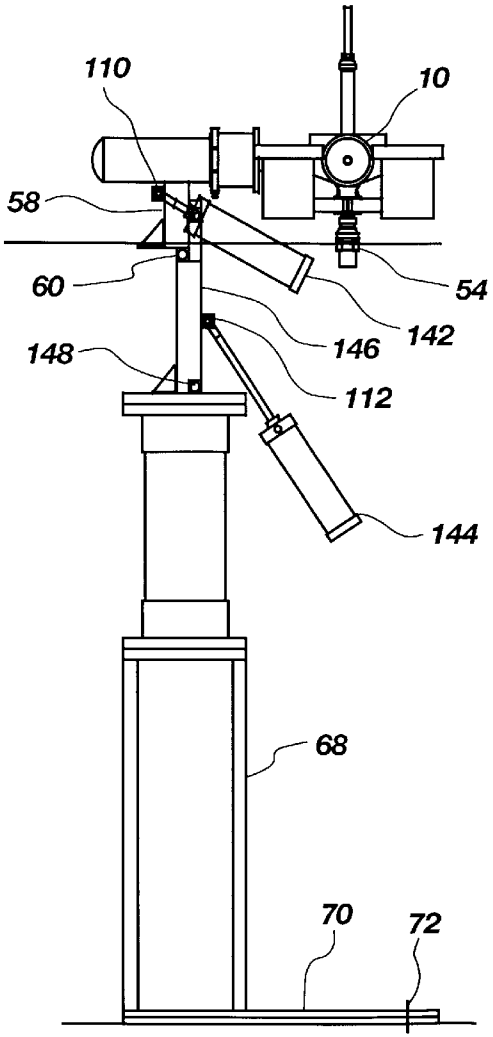
FIG. 11*c* is a side view of the fountain apparatus of FIG. 11*a* in night position (non-submerged) with respect to liquid level of a pool.
Figure 11B:
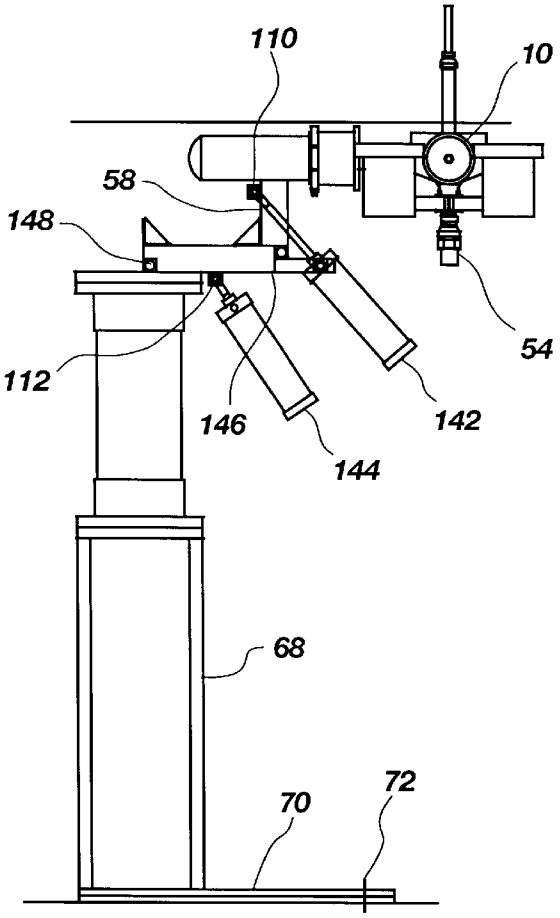
FIG. 11*b* is a side view of the fountain apparatus of FIG. 11*a* in day position (partially submerged) with respect to liquid level of a pool.
Figure 11A:
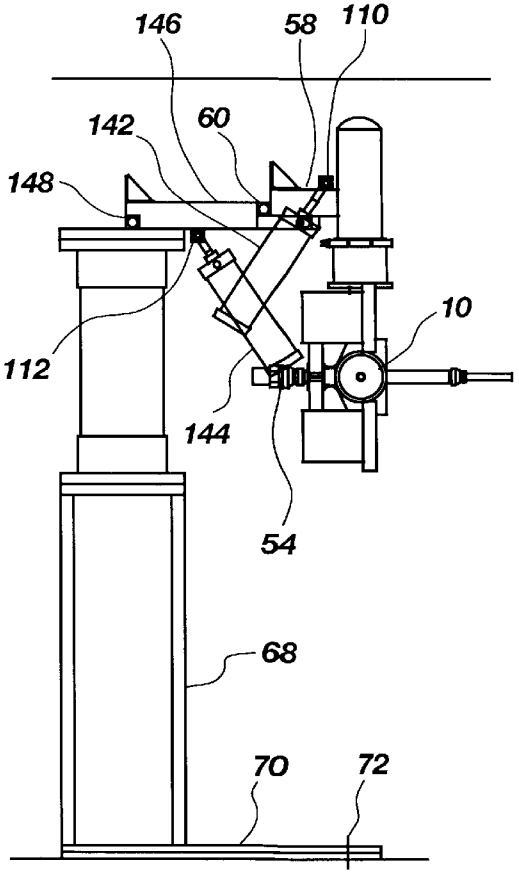
FIG. 11*a* is a side view of the fountain apparatus of FIG. 1 in hidden position (submerged) with respect to liquid level of a pool illustrating an alternative embodiment for selectively varying an elevation of a nozzle with two pivoting arms and pneumatic cylinders.

A fountain apparatus with two pivoting arms moved by linear pneumatic cylinders is illustrated in FIGS. 11*a*, 11*b*, and 11*c*. The example in FIG. 11 a shows the fountain apparatus in a hidden position submerged. When a first linear pneumatic cylinder 142 is actuated, a support arm 58 is rotated about a pivot 60 to allow the nozzle assembly 10 to be partially submerged or day position as shown in FIG. 11*b*. With the first linear pneumatic cylinder 142 is deactivated and a second linear pneumatic cylinder 144 activated, a second support arm 146 rotates from a second pivot 148 against the base support 68 to obtain a non-submerged or night position as shown in FIG. 11*c*.

Figures 12A, 12B:
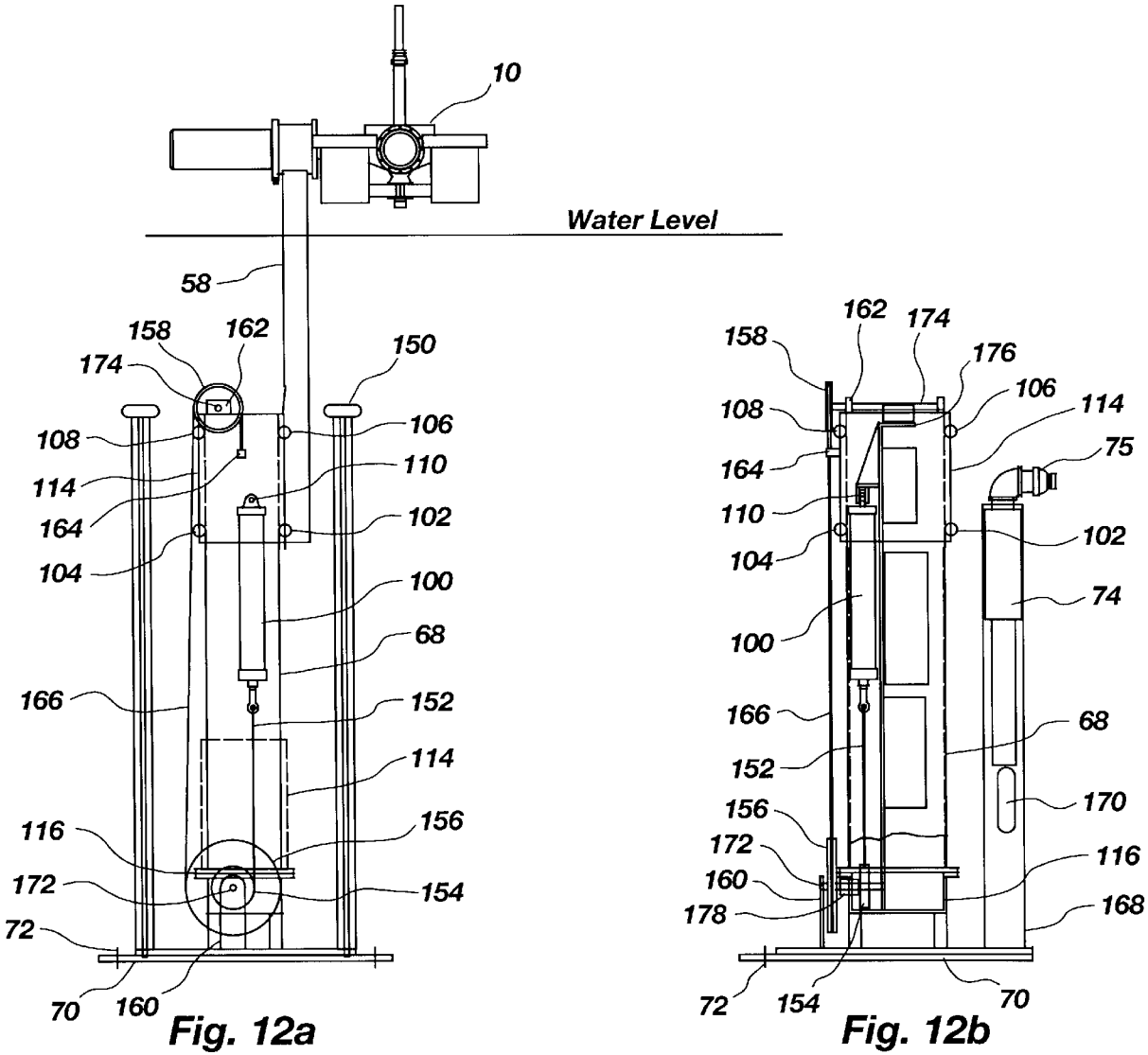
FIG. 12*a* is a side view of the fountain apparatus of FIG. 1 in night position (non-submerged) with respect to liquid level of a pool illustrating an alternative embodiment for selectively varying an elevation of a nozzle with a pneumatic cylinder, pulleys, and cables.
FIG. 12*b* is a front view of the fountain apparatus of FIG. 12*a;*

FIG. 12 is an example of a fountain apparatus which uses a pneumatic cylinder along with pulleys and cables contained in an oarsman retainer 150 to selectively vary an elevation of a nozzle assembly 10. A dual position linear cylinder 100 is attached to an inner support structure 176 and when activated pulls a cable 152 up, rotating a first pulley wheel 154 which spins a lower pulley shaft 172. When the lower pulley shaft 172 rotates, a second pulley wheel 156 attached by a coupling 178 and supported by a lower pulley support 160. The second pulley wheel 156 pulls down a second cable 166 which rotates a third pulley wheel 158 about an upper pulley shaft 174 that is supported by an upper pulley support 162. The second cable 166 is affixed to a lift tube 114 with a cable attachment 164 that pulls the lift tube 114 up using linear roller bearings 102, 104, 106, 108 against a base support 68. The lift tube 114 is attached to a support arm 58 and allows the nozzle assembly 10 to raise and lower. A pump column support 168 contains a submersible pump 74 positioned next to the fountain apparatus. A flow inlet 170 is cut out of the pump support column 168 to allow flow into the pump and out the pump connector 75 to supply the nozzle assembly 10 with a fluid.

In FIGS. 13–16, examples of a fountain apparatus are illustrated which use pneumatic cylinders and a support arm 58 that rotates about a pivot 60 supported by a base support 68. A dual position linear pneumatic cylinder 100 is used in FIG. 13. While the dual position linear pneumatic cylinder 100 is deactivated, the nozzle assembly 10 is in a hidden position submerged. Activating one portion of the dual position linear pneumatic cylinder 100 moves the nozzle assembly into a day position partially submerged. Fully activated, the dual position linear pneumatic cylinder 100 moves the nozzle assembly into a night position nonsubmerged.

Figure 14:
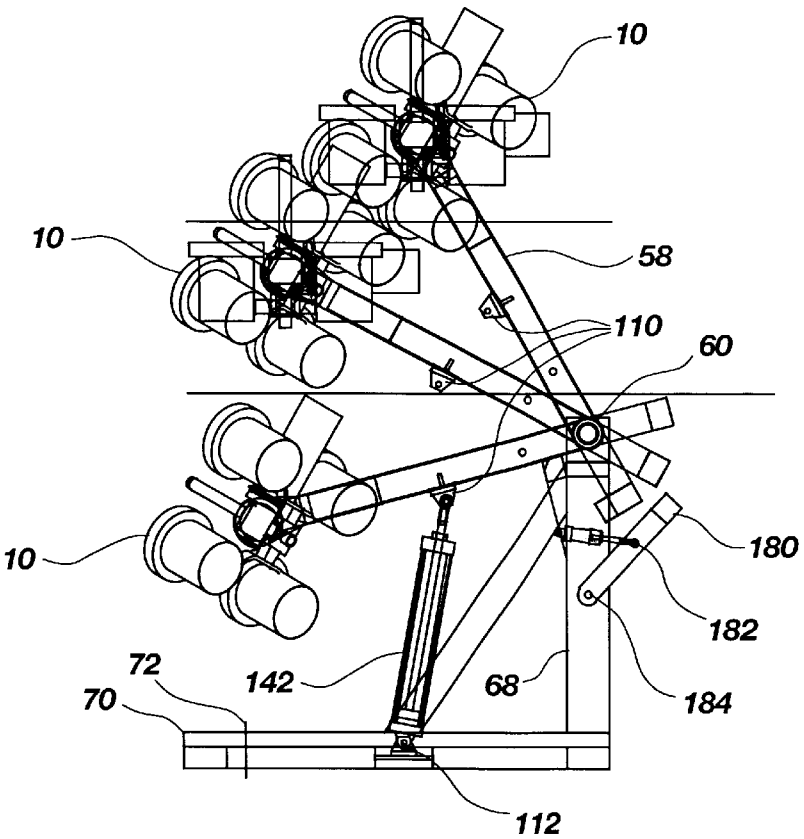
FIG. 14 is a side view of the fountain apparatus of FIG. 1 illustrating an alternative embodiment for selectively varying an elevation of a nozzle in three positions with two linear pneumatic cylinders and pivoted support arm.
Figure 13:
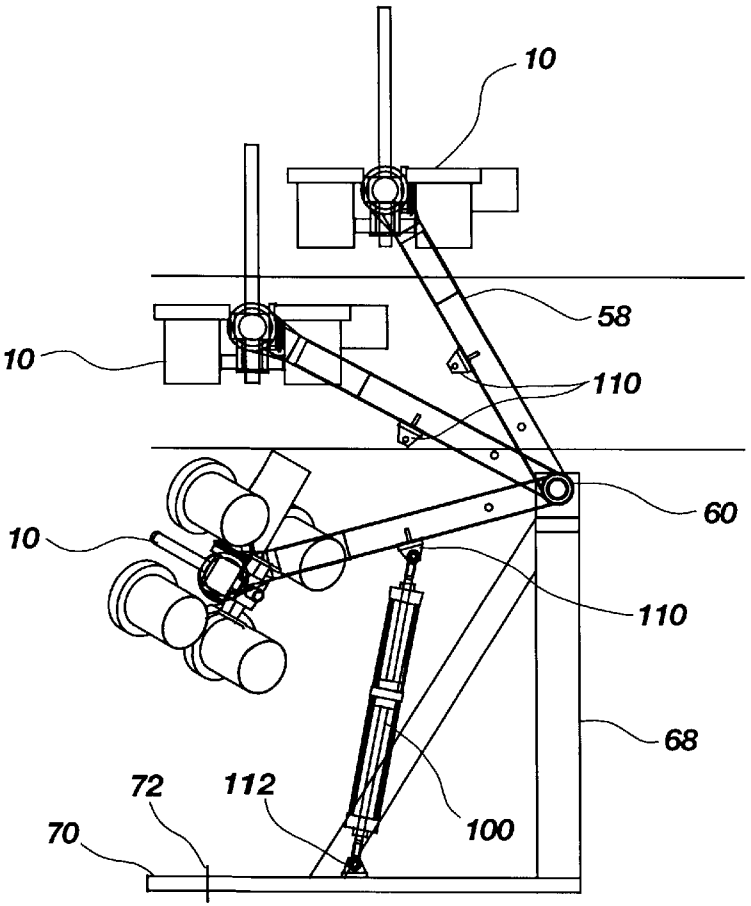
FIG. 13 is a side view of the fountain apparatus of FIG. 1 illustrating an alternative embodiment for selectively varying an elevation of a nozzle in three positions with a dual position linear pneumatic cylinder and pivoted support arm.

The same basic method is used in FIG. 14. A linear pneumatic cylinder 142 is used to push the support arm 58 against a middle position stop 180 which places the nozzle assembly in a day position partially submerged. A linear cylinder 182 pushes against the middle position stop 180 rotating about a pivot 184 which releases the support arm 58 to achieve a night position non submerged.

Figure 16:
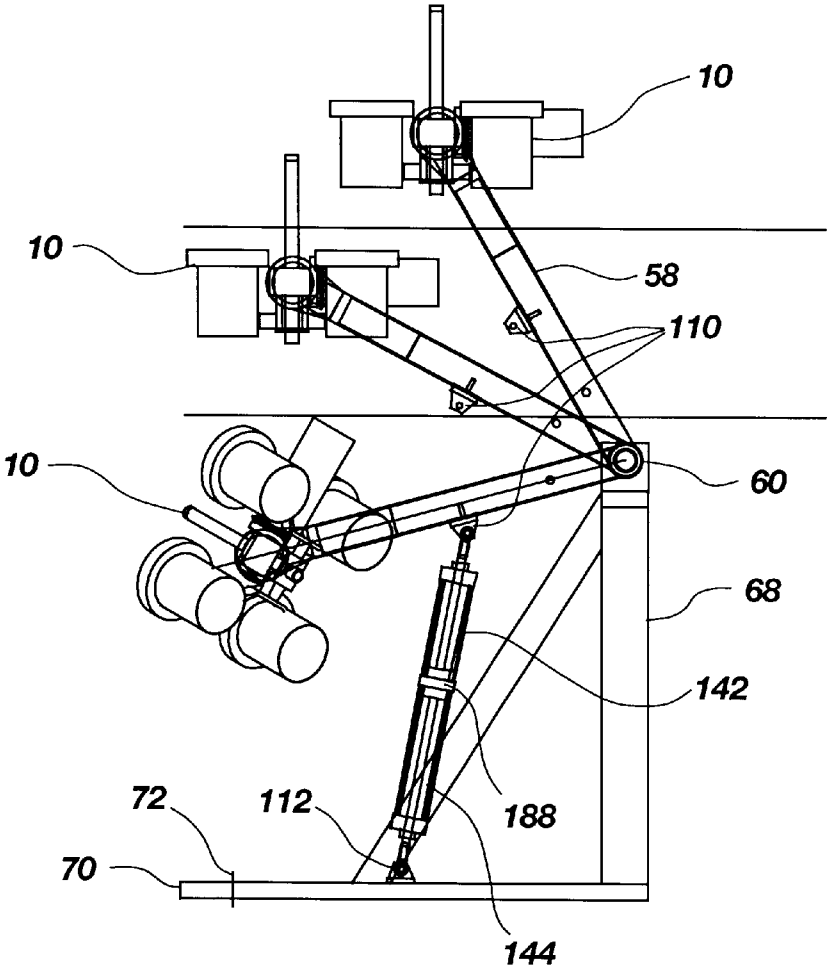
FIG. 16 is a side view of the fountain apparatus of FIG. 1 illustrating an alternative embodiment for selectively varying an elevation of a nozzle in three positions with two linear pneumatic cylinders bolted together and pivoted support arm.
Figure 15:
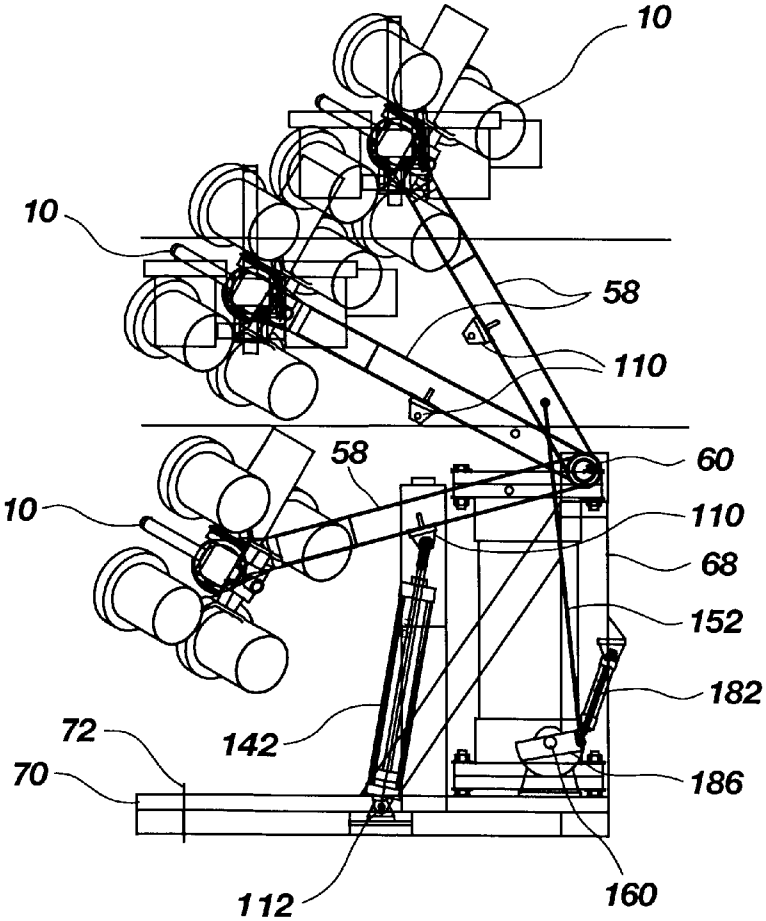
FIG. 15 is a side view of the fountain apparatus of FIG. 1 illustrating an alternative embodiment for selectively varying an elevation of a nozzle in three positions with two linear pneumatic cylinders, a pivoted stop, and pivoted support arm.

The fountain apparatus in FIG. 15 uses the same method as FIG. 14 except a rotating stop 186 is used to pull a cable 152 against a support arm 58 so that the arm is only allowed to move in day position when the linear pneumatic cylinder 182 is activated. FIG. 16 uses the same method as FIG. 13 except a linear pneumatic cylinder 142 is coupled to a second linear pneumatic cylinder 144 with a bolted connector 188.

Figure 17A:
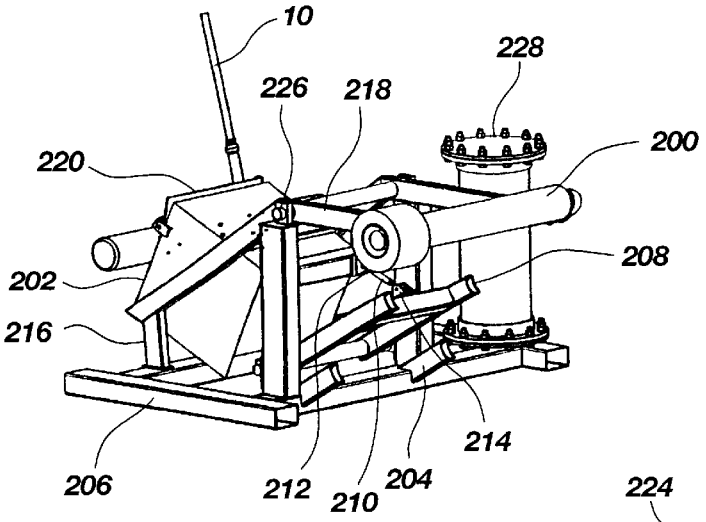
FIG. 17*a* is an isometric view of the fountain apparatus of FIG. 1 in hidden position (submerged) with respect to liquid level of a pool illustrating an alternative embodiment for selectively varying an elevation of a nozzle with a pivoting rocker arm, buoyant tank, counterweight and position stops.
Figure 17B:
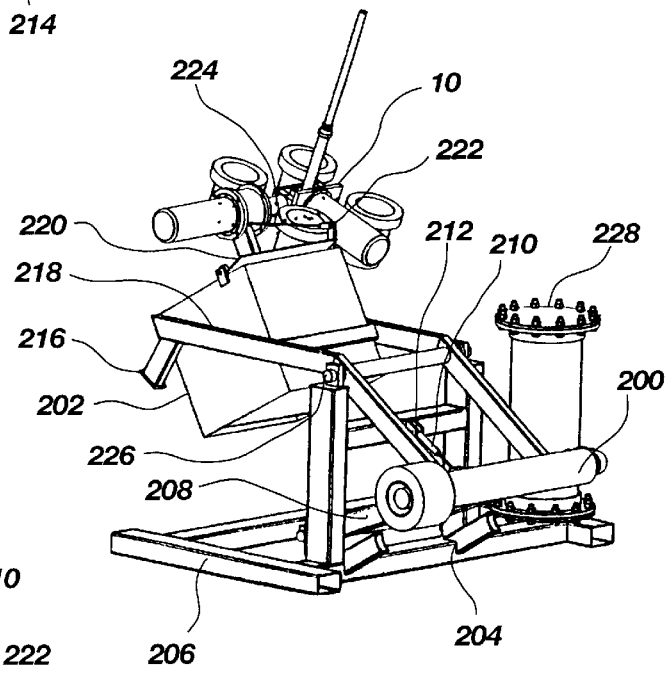
FIG. 17*b* is an isometric view of the fountain apparatus of FIG. 17*a* in day position (partially submerged) with respect to liquid level of a pool.
Figure 17C:
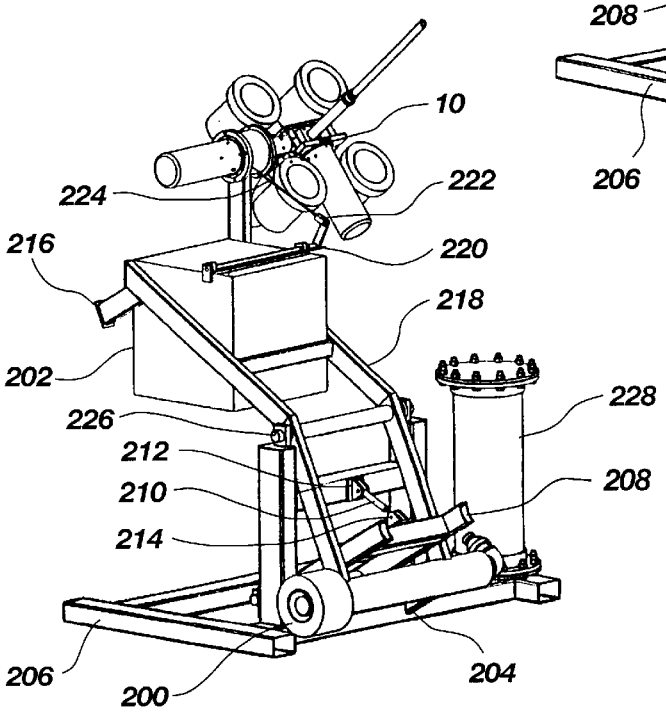
FIG. 17*c* is an isometric view of the fountain apparatus of FIG. 17*a* in night position (non-submerged) with respect to liquid level of a pool.

Referring now to FIG. 17, an alternative embodiment of a fountain apparatus is illustrated for selectively varying an elevation of a nozzle assembly 10 with a pivoting rocker arm 218 and a buoyant tank 202. In hidden position submerged as shown in FIG. 17*a*, the buoyant tank 202 is deflated rendering the nozzle assembly 10 to rest on a base support structure 206 with a buoyant tank support stop 216. The buoyant tank 202 may be filled with air or a gas after a pneumatic cylinder 222 is contracted to release the tension in a cable 224 and thereby closing a vent flap 220 on the buoyant tank 202. The buoyant tank 202 when filled with air or a gas becomes buoyant causing the nozzle assembly 10 to raise, rotating about a pivot 226 with assistance from a counterweight/submersible pump container 200. The nozzle assembly 10 raises until the counterweight/submersible pump container 200 rests on a day time position stop 208 as shown in FIG. 17*b*. The day time position stop 208 may be released by contracting a pneumatic cylinder 210 which is attached to the base support structure 206 with a first attachment 212 and the day time position stop 208 with a second attachment 214 allowing the counterweight/submersible pump container 200 to rotate further until resting on a night time position stop 204 as shown in FIG. 17*c*. An electrical/controls enclosure 228 is sealed in a water tight enclosure and located near the fountain apparatus to control movement.

Figure 18C:
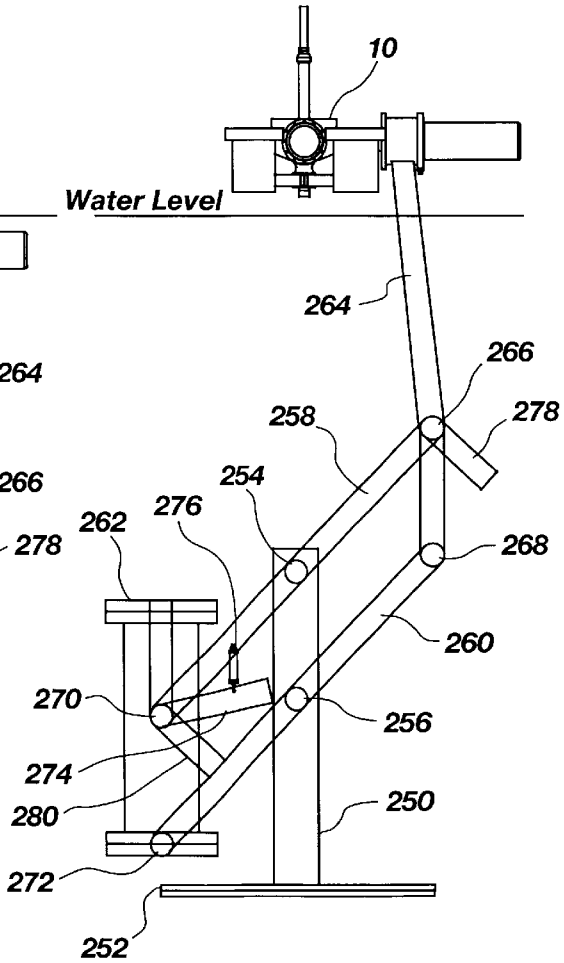
FIG. 18*c* is a side view of the fountain apparatus of FIG. 18*a* in night position (non-submerged) with respect to liquid level of a pool.
Figure 18B:
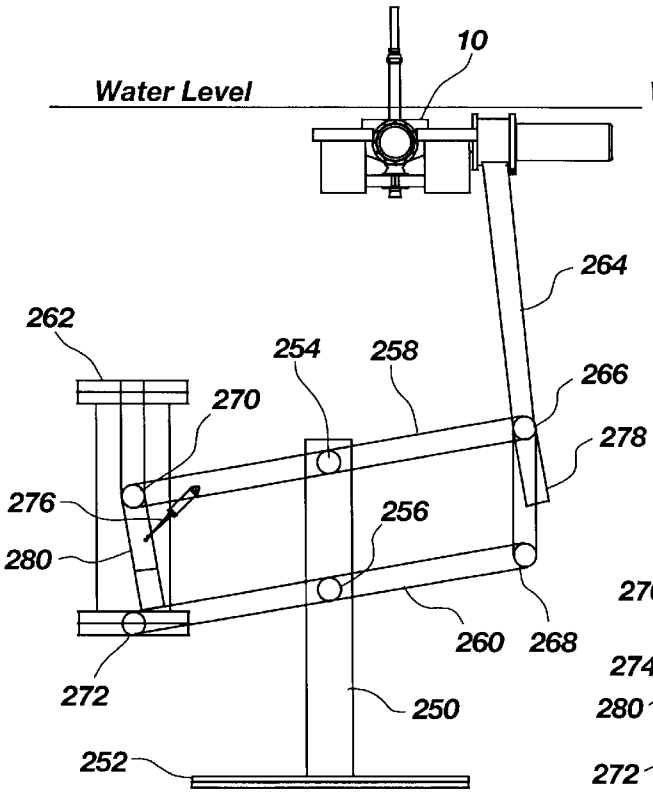
FIG. 18*b* is a side view of the fountain apparatus of FIG. 18*a* in day position (partially submerged) with respect to liquid level of a pool.
Figure 18A:
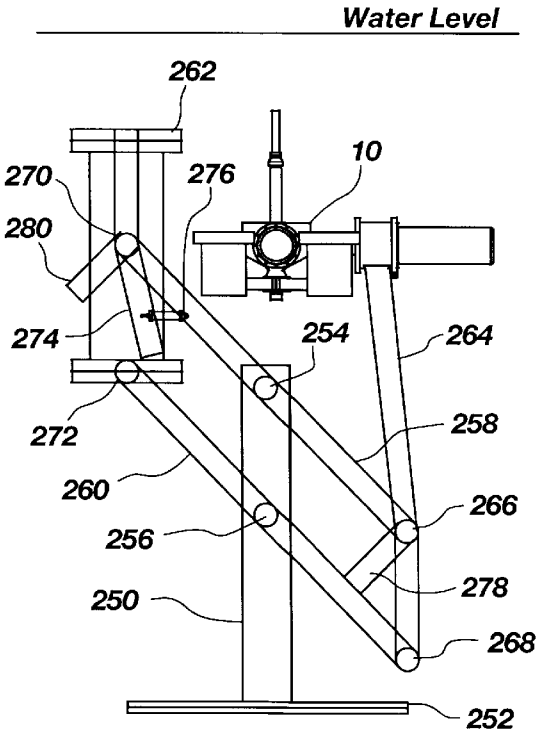
FIG. 18*a* is a side view of the fountain apparatus of FIG. 1 in hidden position (submerged) with respect to liquid level of a pool illustrating an alternative embodiment for selectively varying an elevation of a nozzle with two pivoting swing arms, a buoyant tank, position stops, and a pneumatic cylinder.

FIG. 18 is another example of a fountain apparatus using a buoyant tank 262, an upper swing arm 258 and a lower swing arm 260 to achieve a means for selectively varying an elevation. The hidden position submerged is illustrated in FIG. 18*a*, where the buoyant tank 262 raises the swing arms to rotate about pivots 254 and 256 on a base support 250 that is attached to a foundation plate 252 affixed to the bottom of a pool. The buoyant tank 262 elevates until a hidden position stop 278 attached to the upper swing arm 258 rests on the lower swing arm 260. When the buoyant tank 262 is deflated, it acts as a counterweight sinking to the bottom of the pool and causing the nozzle assembly 10 attached to a support arm 264 to raise until the structure rests on a day position stop 274 as shown in FIG. 18*b*. The buoyant tank 262 and nozzle assembly 10 remain substantially upright during rotation by using two pivots 270 and 272 on the buoyant tank 262 and two pivots 266 and 268 on the support arm 264. A pneumatic cylinder 276 is contracted to deactivate the day position stop 274 that allows the buoyant tank 262 to drop and the nozzle assembly 10 to raise until the structure rests on a night position stop 280 attached to the upper swing arm 258 as shown in FIG. 18*c*.

Figure 19C:
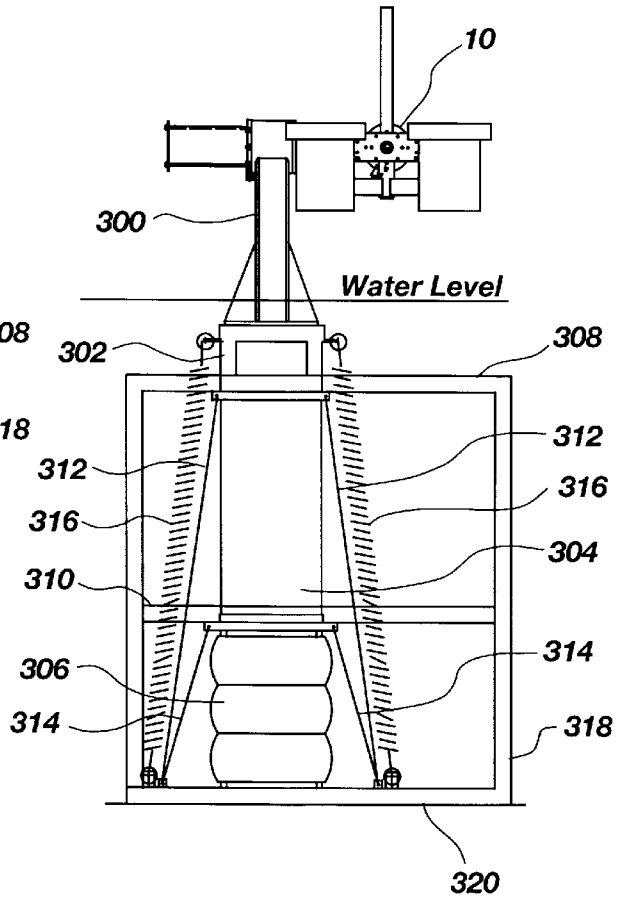
FIG. 19*c* is a side view of the fountain apparatus of FIG. 19*a* in night position (non-submerged) with respect to liquid level of a pool.
Figure 19B:
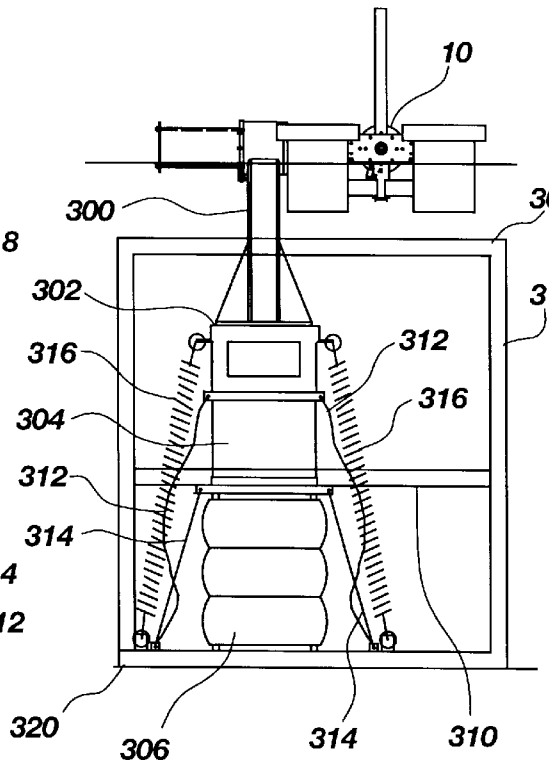
FIG. 19*b* is a side view of the fountain apparatus of FIG. 19*a* in day position (partially submerged) with respect to liquid level of a pool.
Figure 19A:
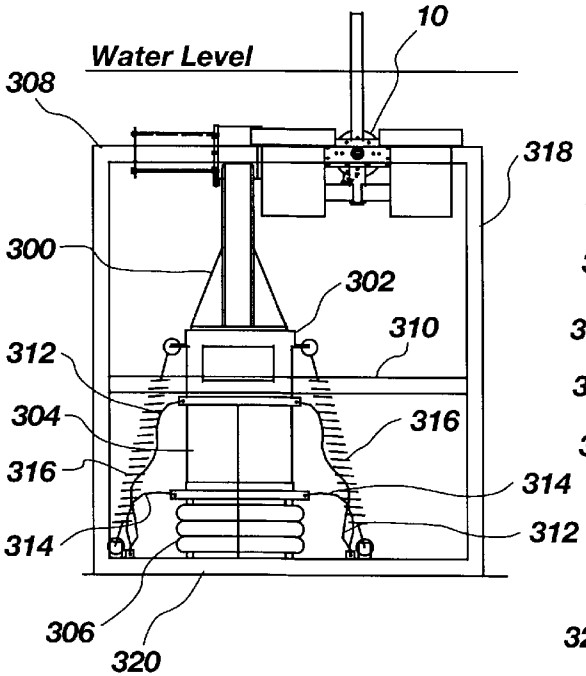
FIG. 19*a* is a side view of the fountain apparatus of FIG. 1 in hidden position (submerged) with respect to liquid level of a pool illustrating an alternative embodiment for selectively varying an elevation of a nozzle with two air springs, stop cables, and an extension spring.

An further example of fountain apparatus for selectively varying an elevation of a nozzle is illustrated in FIG. 19 using air springs. FIG. 19*a* illustrates the fountain apparatus in hidden position submerged by contracting an extension spring 316 attached to an upper column support 302 against an upper air spring 304 and a lower air spring 306. A nozzle assembly 10 attached to a support arm 300 which is attached to the upper support column 302 is raised by inflating the lower air spring 306 as shown in FIG. 19*b* until the structure rests on a lower lock beam 310 and lower lockcables 314. A non-submerged position as shown in FIG. 19*c* is achieved by inflating a the upper air spring 304 until the structure rests on an upper lock beam 308 and upper lock cables 312. The upper lock beam 308 and lower lock beam 310 act as a guide for the air springs and are supported by a support frame 318 that is anchored to a pool floor by a base support frame 320.

Figure 21:
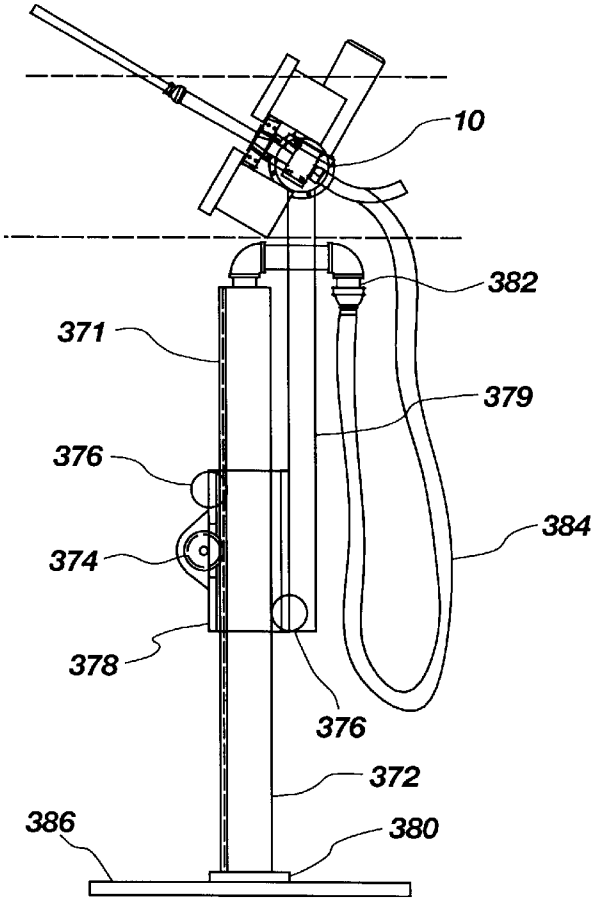
FIG. 21 is a side view of the fountain apparatus of FIG. 1 in day position (partially submerged) with respect to liquid level of a pool illustrating an alternative embodiment for selectively varying an elevation of a nozzle with a rack and pinion.
Figure 20:
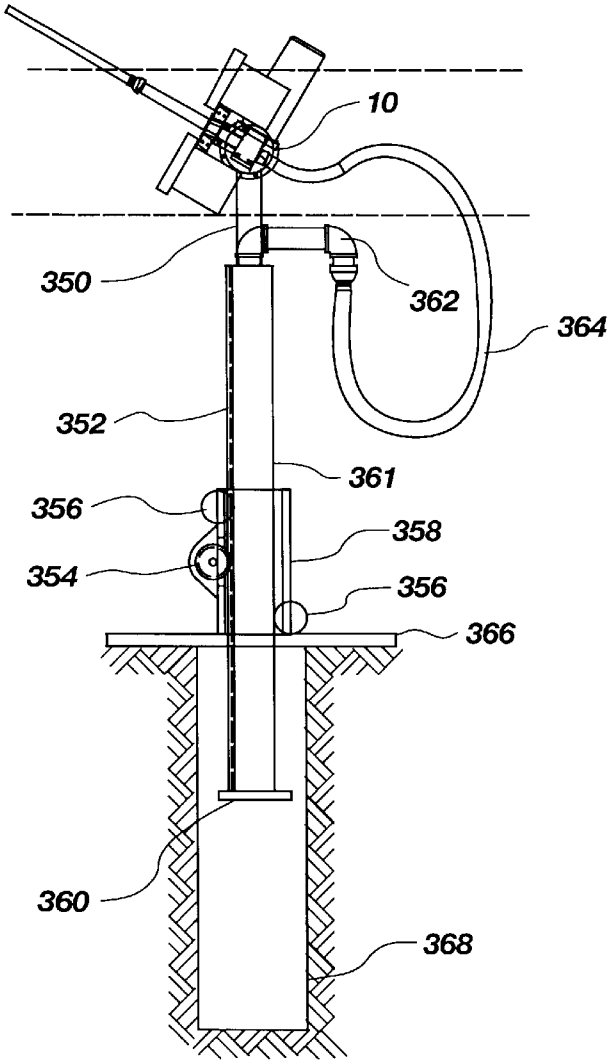
FIG. 20 is a side view of the fountain apparatus of FIG. 1 in day position (partially submerged) with respect to liquid level of a pool illustrating an alternative embodiment for selectively varying an elevation of a nozzle with a rack and pinion in a pit.

FIGS. 20 and 21 illustrate an alternative embodiment for selectively varying an elevation of a nozzle with a rack and pinion assembly. The nozzle assembly 10 attached to a rack 352 by a support arm 350 may be raised by a pinion 354 attached to a pinion support structure 358 until the structure rests on a stop 360. The pinion support structure 358 also aligns the rack 352 with the help of linear roller bearings 356. The pinion support structure 358 sits over a pit 368 and is supported by a foundation plate 366 for easier adjustability in shallow pools. A submersible pump 361 may be attached to the rack 352 which pumps fluid through hose fittings 362 to a flexible hose 364 and out the nozzle assembly 10.

FIG. 21 shows an embodiment that also uses a rack and pinion, although a base foundation plate 386 is affixed to a rack 371 in stationary position. A pinion 374 supported by a pinion support 378 moves up and down the rack 371 with the assistance of roller bearings 376, thus causing the nozzle assembly 10 attached by a support arm 370 varies the nozzle elevation accordingly. A pump casing 372 may be attached to the rack 371 which contains a pump to force fluid through hose fittings 382 to a flexible hose 384 and out the nozzle assembly 10. A clearance stop 380 may be added to the base foundation plate 386 to prevent structural damage.

Figure 22C:
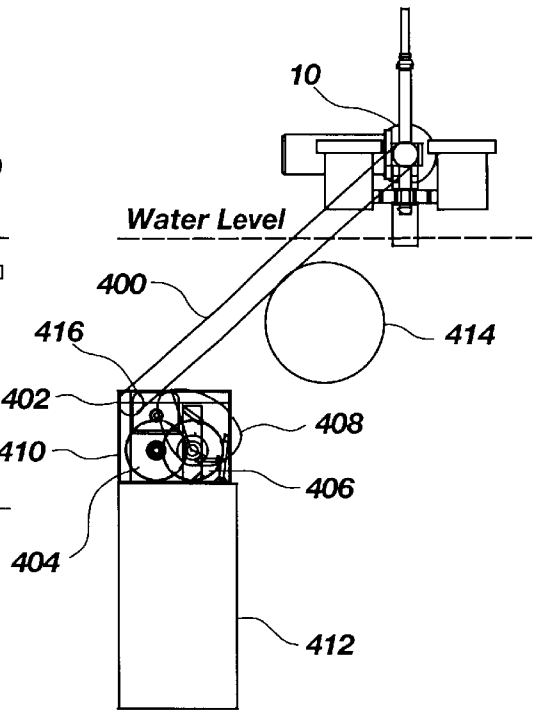
FIG. 22*c* is a side view of the fountain apparatus of FIG. 22*a* in night position (non-submerged) with respect to liquid level of a pool.
Figure 22B:
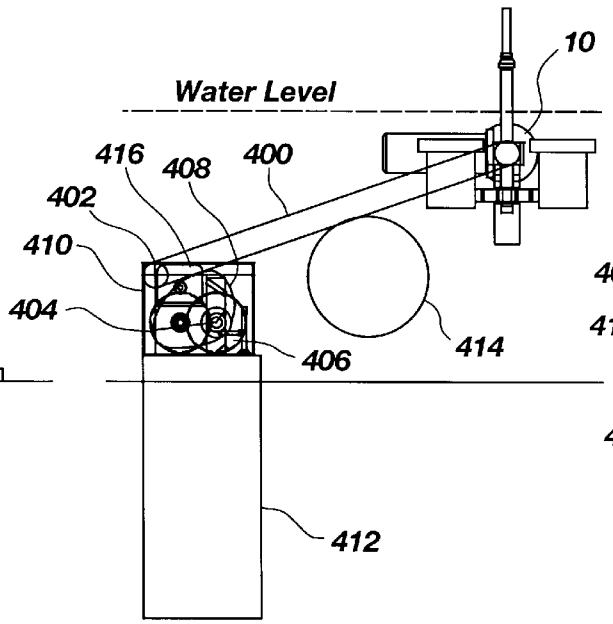
FIG. 22*b* is a side view of the fountain apparatus of FIG. 22*a* in day position (partially submerged) with respect to liquid level of a pool.
Figure 22A:
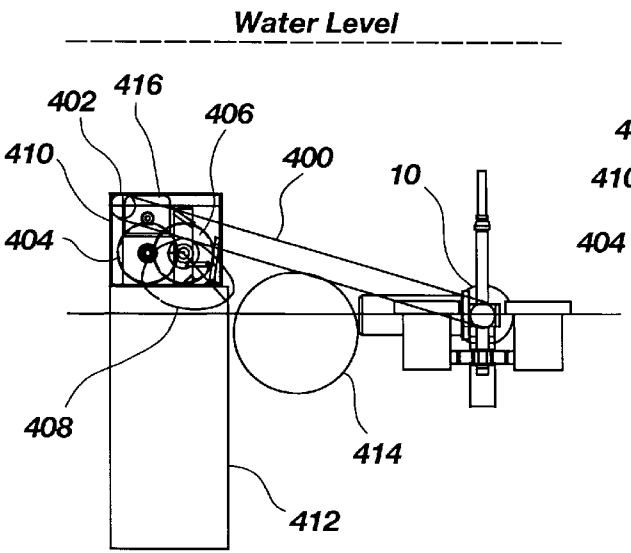
FIG. 22*a* is a side view of the fountain apparatus of FIG. 1 in hidden position (submerged) with respect to liquid level of a pool illustrating an alternative embodiment for selectively varying an elevation of a nozzle with a cam/gear motor mechanism and a buoyant tank.

Regarding FIGS. 22*a*, 22*b*, and 22*c*, a fountain apparatus illustrates an alternative embodiment for selectively varying an elevation of a nozzle with a cam gear mechanism 408. The varying nozzle elevations are achieved by the cam gear mechanism 408 pushing against a support arm 400 to raise or lower the nozzle assembly 10. The support arm rotates about a pivot 402 that is supported by a mechanical frame enclosure 410 on top of a base support/electronic and pump enclosure 412. The cam gear mechanism 408 is powered by a gear motor with a pinion gear 416 that rotates an idler sprocket with a pinion 404 which in turn rotates a drive gear 406 then the cam gear mechanism 408. A buoyant tank 414 may be added to the specified fountain apparatus to assist the cam gear mechanism 408 in lifting the support arm 400.

Figure 23:
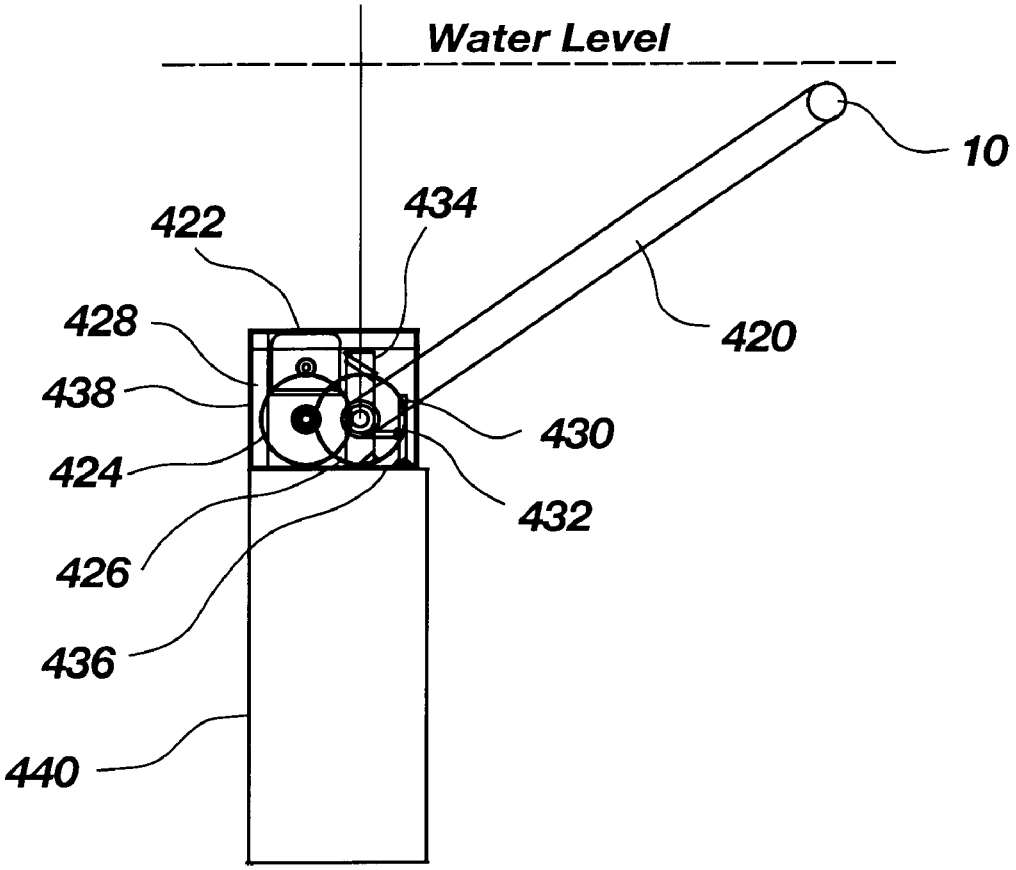
FIG. 23 is a side view of the fountain apparatus of FIG. 1 in day position (partially submerged) with respect to liquid level of a pool illustrating an alternative embodiment for selectively varying an elevation of a nozzle with gear motor mechanism.
Figure 24:
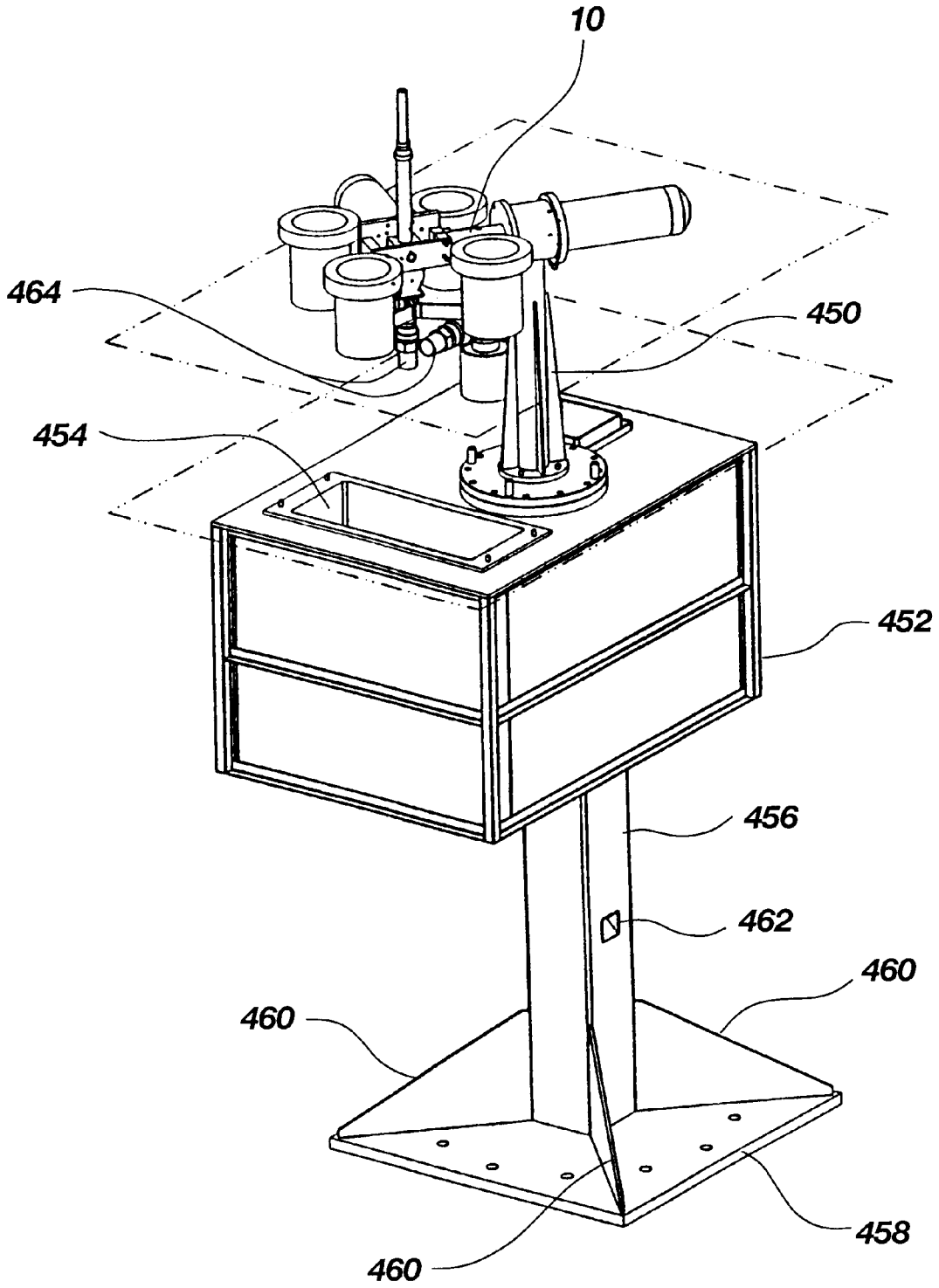
FIG. 24 is a side view of the fountain apparatus of FIG. 1 illustrating an alternative embodiment for selectively varying an elevation of a nozzle with a buoyant tank and internal stops.

FIG. 23 operates on the same principle as FIGS. 22*a–c* but with a gear motor mechanism. A support arm 420 pivots about a drive gear 426 to produce an angle θ, raising and lowering the nozzle assembly. A gear motor with a pinion 422 powers an idler sprocket with a pinion 424 which in turn rotates the drive gear 426. The gear motor mechanism is enclosed in a mechanical enclosure 438 that contains an oil bath 428 and is supported on a base support/electrical and pump enclosure 440. The support arm positions are regulated by a day position stop 430, a night position stop 432 and a hidden position stop 436 whereas the day position stop 430 may be disengaged with a stop disengagement mechanism 432.

Another example of a fountain apparatus illustrates a vertical lift using a buoyant tank 452 with internal stops 462. The buoyant tank 452 also serves as a support structure for a support arm 450 that supports the nozzle assembly 10. A base support column 456 is affixed to a pool floor by a base foundation plate 458 with gussets 460. An air vent 454 allows the air or gas to escape from the buoyant tank 452 to lower the structure. Pump hose connections 464 are shown which are used to connect a hose to pump fluid out a nozzle.

Figure 25C:
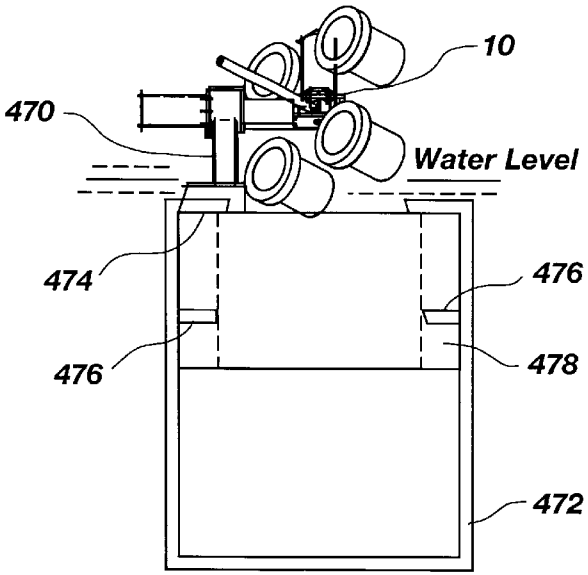
FIG. 25*c* is a side view of the fountain apparatus of FIG. 25*a* in night position (non-submerged) with respect to liquid level of a pool.
Figure 25B:
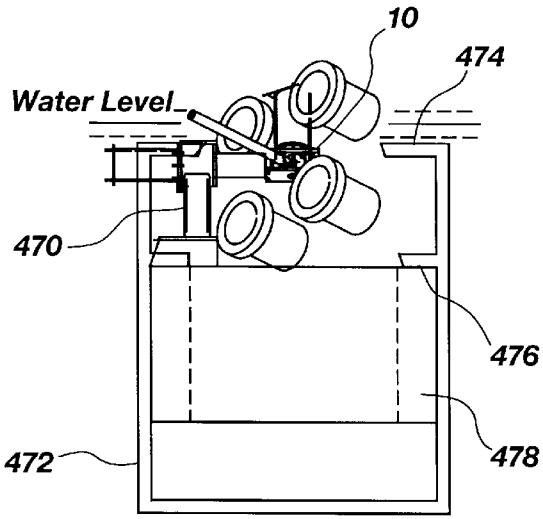
FIG. 25*b* is a side view of the fountain apparatus of FIG. 25*a* in day position (partially submerged) with respect to liquid level of a pool.
Figure 25A:
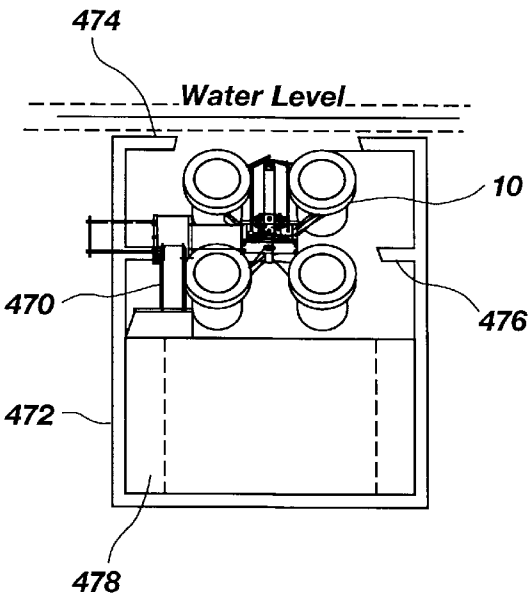
FIG. 25*a* is a side view of the fountain apparatus of FIG. 1 in hidden position (submerged) with respect to liquid level of a pool illustrating an alternative embodiment for selectively varying an elevation of a nozzle with a square buoyant tank and external frame structure.

A square buoyant tank 478 and an external frame structure 472 is illustrated in FIG. 25. The nozzle assembly is attached to the square buoyant tank 478 by a support arm 470 and raised and lowered though the external frame structure 472. Elevations are set by a day position stop 476 and a night position stop 474 where the day position stop 476 may be disengaged.

Figure 26:
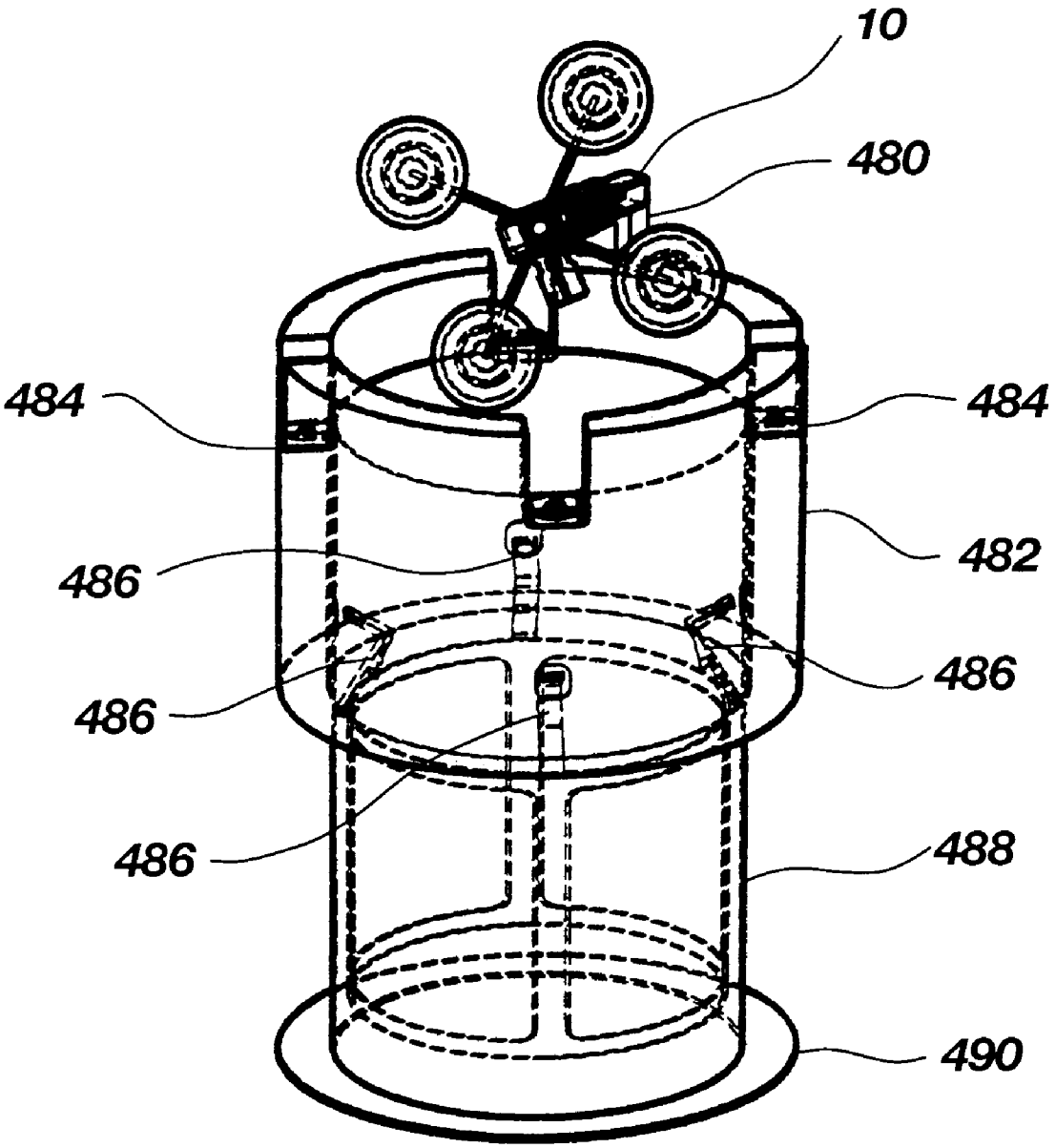
FIG. 26 is an isometric view of the fountain apparatus of FIG. 1 in operating position (non-submerged) with respect to liquid level of a pool illustrating an alternative embodiment for selectively varying an elevation of a nozzle with a round, fiberglass buoyant tank and internal support column.

FIG. 26 illustrates an alternative embodiment of a fountain apparatus for selectively varying an elevation of a nozzle with a round, fiberglass buoyant tank 482 and an internal support column 488 that is affixed to a pool floor with a base foundation plate 490. The nozzle assembly 10 is attached to the fiberglass buoyant tank 482 with a support arm. Elevation adjustments are made with stops 484 and stop engagement mechanisms 486.

It will be appreciated that the structure and apparatus disclosed herein is merely one example of a means for a fountain, and it should be appreciated that any structure, apparatus or system for a fountain which performs functions the same as, or equivalent to, those disclosed herein are intended to fall within the scope of a means for a fountain, including those structures, apparatus or systems for a fountain which are presently known, or which may become available in the future. Anything which functions the same as, or equivalently to, a means for fountain falls within the scope of this element.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Water displays are greatly enhanced by adding two degrees of freedom to a water fountain in axes that are approximately perpendicular and combining the ability to automatically manipulate movement of the spray nozzle by employing automated and programmable controls. Thus, the present invention provides a fountain apparatus capable of articulating a wide range of motion as well as programing set patterns of movement for water fountain displays. A preferred design concept includes a spray nozzle with lights to track the stream and two rotatable devices to allow two degrees of freedom which are in axes approximately perpendicular.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A fountain apparatus comprising;

at least one nozzle;

a means for moving the at least one nozzle in at least two degrees of freedom about two axes that are approximately perpendicular;

an automated control system for controlling movement of said at least one nozzle and thus a trajectory of a liquid that is emitted from said at least one nozzle; and a liquid source in fluid communication with said at least one nozzle for providing a pressurized flow to the at least one nozzle.

2. The fountain apparatus of claim 1, further, including a means associated with the liquid source for varying the pressurized flow to said at least one nozzle.

3. The fountain apparatus of claim 2, wherein said automated control system controls said means for varying.

4. The fountain apparatus of claim 2, wherein said automated control system controls said means for varying the pressurized flow.

5. The fountain apparatus of claim 1, wherein, said automated control system controls rotational movement of said at least one nozzle in pivotal movement.

6. The fountain apparatus of claim 1, wherein said movement of said at least one nozzle is translatory movement.

7. The fountain apparatus of claim 1, wherein said means for moving comprises an arm pivotally mounted at a first portion to a nozzle support structure and the at least one nozzle is pivotally mounted to said nozzle support structure.

8. The fountain apparatus of claim 7, further comprising said arm having a second portion pivotally mounted to a base structure.

9. The fountain apparatus of claim of 8, wherein pivoting of said nozzle support structure relative to said arm and said arm relative to said base is selectively controllable by said automated control system.

10. The fountain apparatus of claim 8, wherein said liquid source comprises a pool of liquid and a pump in fluid communication with said pool.

11. The fountain apparatus of claim 10, wherein said pump is coupled to said arm for providing a counterweight.

12. The fountain apparatus of claim 1, wherein said automated control system regulates the height of the at least one nozzle relative to a support surface whereas the elevation of said at least one nozzle can be varied.

13. The fountain apparatus of claims 4 or 12, wherein said pressurized flow, nozzle and nozzle elevation are controlled by the automated control system.

14. The fountain apparatus of claim 12, wherein said at least one nozzle is configured to be placed in a pool of liquid and wherein said elevation of said at least one nozzle can be selectively varied such that said nozzle support structure and said at least one nozzle can be non-submerged, partially submerged, or fully submerged in said pool.

15. The fountain apparatus of claim 1, further including a light source for directing a light beam substantially toward said flow.

16. The fountain apparatus of claim 15, wherein movement of a second light source is controlled by said automated control system that is capable of articulating said light source and said second light source in at least one degree of freedom.

17. The fountain apparatus of claim 1, further including a support structure coupled to said at least one nozzle for supporting said at least one nozzle relative to a support surface.

18. The fountain apparatus of claim 17, wherein said support structure is attached to a buoyant device.

19. The fountain apparatus of claim 1, further including a programable computer system which articulates movements in preset patterns.

20. The fountain apparatus of claim 1, wherein said means for moving comprises at least one servo-motor.

21. The fountain apparatus of claim 1, further including at least one interchangeable nozzle spray pattern insert securable relative to said at least one nozzle for altering a spray pattern of the at least one nozzle.

22. The fountain apparatus of claim 1, further including a sound control system capable of varying a flow trajectory depending upon music rhythm.

23. A fountain apparatus comprising;

at least one nozzle;

a first selectively rotatable device coupled to said at least one nozzle;

a nozzle support coupled to the first rotatable device, whereas said first rotatable device is capable of rotating said at least one nozzle relative to said nozzle support;

a second selectively rotatable device coupled to said nozzle support;

a support arm coupled to the second rotatable device, whereas said second rotatable device is capable of rotating said nozzle support relative to the support arm;

an automated control system for selectively controlling rotation of said first and second rotational devices and thus the direction of a flow stream of a liquid that is emitted from said at least one nozzle; and a liquid source in fluid communication with said at least one nozzle for providing a pressurized flow to at least one nozzle.

24. The fountain apparatus of claim 23, further including a valve associated with the liquid source for varying the pressurized flow to said at least one nozzle, whereas said automated control system controls said valve.

25. The fountain apparatus of claim 23, further including a third rotatable device coupled to said support arm whereas a base support structure coupled to the third rotatable device is capable of rotating said support arm relative to the base support structure.

26. The fountain apparatus of claims 23 or 25, wherein said rotatable device comprises at least one servo-motor.

27. The fountain apparatus of claim 25, wherein said pressurized flow, nozzle angle, and nozzle elevation are controlled by said automatic control system.

28. The fountain apparatus of claim 27, wherein said at least one nozzle is configured to be placed in a pool of liquid and wherein said elevation of said at least one nozzle can be selectively varied such that said nozzle support structure and said at least one nozzle can be non-submerged, partially submerged, or fully submerged in said pool.

29. The fountain apparatus of claim 25, wherein said liquid source comprises a pool of liquid and a pump in fluid communication with said pool.

30. The fountain apparatus of claim 29, wherein said pump is coupled to said support arm for providing a counterweight for said at least one nozzle.

31. The fountain apparatus of claim 23, further including a programable computer system which articulates movements in preset patterns.

32. The fountain apparatus of claim 23, further including a light source for directing a light beam substantially toward said flow whereas movement is in unison with said at least one nozzle.

33. The fountain apparatus of claim 23, further including at least one interchangeable nozzle spray pattern insert securable relative to said at least one nozzle for altering a spray pattern of the at least one nozzle.

34. A fountain apparatus comprising;

at least one nozzle;

a first device coupled to said at least one nozzle and capable of rotating said at least one nozzle about a first axis of rotation;

a second device coupled to said first device capable of rotating said first device about a second axis of rotation; and a control system for controlling rotation of said first device and said second device and thus control positioning of said at least one nozzle.

35. The fountain apparatus of claim 34, further including a liquid source in fluid communication with said at least one nozzle for providing a pressurized flow to the at least one nozzle.

36. The fountain apparatus of claim 35, further including means associated with the liquid source for varying the pressurized flow to said at least one nozzle.

37. The fountain apparatus of claim 34, further including means for selectively raising and lowering said at least one nozzle.

38. The fountain apparatus of claim 37, wherein said means for selectively raising and lowering said at least one nozzle comprises an arm pivotally mounted at a first portion to a nozzle support structure, said at least one nozzle mounted to said nozzle support structure.

39. The fountain apparatus of claim 38, wherein said arm includes a second portion pivotally mounted to a base structure.

40. The fountain apparatus of claim of 39, wherein pivoting of said nozzle support structure relative to said arm and said arm relative to said base is selectively controllable by said control system.

41. The fountain apparatus of claim 34, further including a nozzle support structure having the at least one nozzle fixedly attached relative thereto, said first device coupled to said nozzle support structure and capable of rotating said nozzle support structure relative thereto.

42. The fountain apparatus of claim 41, where said nozzle support structure is substantially U-shaped having a first side and a second side such that activation of said first device in a first direction causes said second device to pass between at least a portion of said first side and said second side of said U-shaped nozzle support structure.

43. The fountain apparatus of claim 41, wherein said support structure is attached to a buoyant device.

44. The fountain apparatus of claim 34, further including a light source mounted relative to said at least one nozzle for directing a light beam substantially toward a flow of liquid emanating from said at least one nozzle.

45. The fountain apparatus of claim 34, wherein said first and second devices each comprise a servo-motor.

* * * * *